US007562619B1

(12) United States Patent
Fortier et al.

(10) Patent No.: US 7,562,619 B1
(45) Date of Patent: Jul. 21, 2009

(54) SINGLE RAM BALER WITH PREFLAP AND SHEAR BLADES ASSEMBLIES

(75) Inventors: Paul Fortier, Plessisville (CA); Marc Massé, Princeville (CA)

(73) Assignee: Industries Machinex Inc., Plessiville, Quebec (CA)

( * ) Notice: Subject to any disclaimer, the term of this patent is extended or adjusted under 35 U.S.C. 154(b) by 0 days.

(21) Appl. No.: 12/114,419

(22) Filed: May 2, 2008

(51) Int. Cl.
*B30B 9/30* (2006.01)
*B30B 7/04* (2006.01)
*B65B 13/02* (2006.01)

(52) U.S. Cl. ..... 100/3; 100/2; 100/19 R; 100/98 R; 100/141; 100/191; 100/215; 100/233; 100/240; 100/295; 100/189; 100/232

(58) Field of Classification Search ..... 100/1, 100/3, 8, 17, 19 R, 24, 94, 95, 98 R, 177, 100/178, 179, 191, 192, 215, 218, 240, 245, 100/269.01, 295, 141, 188 R, 189, 232, 233
See application file for complete search history.

(56) References Cited

U.S. PATENT DOCUMENTS 674,836 A 5/1901 Carter
778,446 A 12/1904 Clark et al.
1,049,704 A 1/1913 Green
3,253,537 A 5/1966 Porter et al.
3,350,999 A * 11/1967 Morse ..... 100/43
3,577,911 A 5/1971 Morse
3,587,448 A * 6/1971 Hemphill et al. ..... 100/3
3,667,377 A * 6/1972 Persson ..... 100/19 R
4,059,049 A * 11/1977 Tillgren ..... 100/41
4,121,515 A * 10/1978 Tea ..... 100/98 R
4,134,335 A * 1/1979 O'Rourke et al. ..... 100/98 R
4,144,806 A 3/1979 Broussard
4,149,457 A * 4/1979 Smith ..... 100/98 R
4,489,648 A 12/1984 Naaktgerboren
4,584,935 A * 4/1986 Luggen ..... 100/26
4,651,610 A * 3/1987 Schwelling ..... 83/636
4,676,153 A * 6/1987 Ast ..... 100/7
4,750,418 A 6/1988 Naaktgeboren
4,787,308 A * 11/1988 Newsom et al. ..... 100/50
4,936,206 A 6/1990 Miles et al.
5,353,698 A 10/1994 Robbins
5,566,610 A 10/1996 Robinson et al.
5,832,815 A 11/1998 Bollegraaf
6,360,655 B1 3/2002 Crespo Barrio
6,546,855 B1 4/2003 Van Der Beek et al.
6,651,416 B2 11/2003 Trelstad et al.
6,694,871 B1 2/2004 Wildes et al.

* cited by examiner

*Primary Examiner*—Jimmy T Nguyen
(74) *Attorney, Agent, or Firm*—Alexandre Abecassis; Fasken Martineau DuMoulin LLP

(57) ABSTRACT

The present invention generally pertains to a single ram baler having a preflap assembly and a shear blade assembly. More specifically, the single ram baler of the present invention comprises a preflap assembly operable to pre-compact recycled material of smaller size in a compaction chamber of the baler to improve density properties of the bales produced therewith and to increase the efficiency of the baler. The baler is also operable with recycled material of large dimensions by operating the shear blades assembly without using the preflap assembly.

16 Claims, 26 Drawing Sheets

SINGLE RAM BALER WITH PREFLAP AND SHEAR BLADES ASSEMBLIES

FIELD OF THE INVENTION

The present invention generally relates to a single ram baler. More specifically, the present invention relates to a single ram baler having a preflap and shear blades assembly. The single ram baler of the present invention may further comprise an extrusion channel having at least one wall movable along its entire length.

BACKGROUND OF THE INVENTION

Single ram balers typically comprise a horizontal compaction chamber in which a platen mounted to a press ram moves horizontally, forward and backward, to compact recycled materials provided in the compaction chamber. The recycled material is generally fed in the compaction chamber by gravity, trough a feeding opening defined on the top of the compaction chamber.

Upon compaction by the actuated platen, the compacted material moves toward an extrusion channel mounted to an outlet end of the compaction chamber. The extrusion channel is generally defined by a fixed bottom wall, a pivoting, adjustable, top wall and a pair of spaced-apart, pivoting, sidewalls. Each wall defining the extrusion channel includes a first, inlet end and a second, opposed, outlet end. The inlet end of the pivoting side and top walls are hingedly connected to the outlet end of the compaction chamber. The second outlet end of these pivoting walls is displaceable between an open and a close position, by way of actuator means. The actuator means allows the adjustment of the size of the extrusion channel at the outlet end, therefore increasing the pressure over the compacted recycled material as it is funnelled trough the extrusion channel Because fed material has often a low density, has a lower friction factor, is loose or has a larger size than the actual size of the compaction chamber, the compaction efficiency can be reduced. The prior art describes two general type of devices designed to overcome such problems. The first consists in a shear blade assembly including a first, fixed, blade mounted to one edge of the feeding opening of the compaction chamber and a moving blade, mounted to a top end of the platen. Upon frontward progress of the platen in the compaction chamber, the fixed and moving blades collaborate to guillotine the material lodged in the feeding opening. The fixed blade is generally V-shaped to increase cutting efficiency.

The efficiency of the single ram balers of the prior art having shear blades assembly tend to be reduced since the production of bales typically requires several back and forth movement of the platen to obtain the desired amount of material in the extrusion channel, especially when such material consists in low density material such as fluff paper, plastic containers and the like. Further, shear blades tend not to be of particular assistance in pre-compaction of recycled material of smaller dimension such as plastic and metal containers or smaller sheets of paper and the density of the bales produced therefrom tend not to be satisfactorily uniform (i.e. the compacted material tend to denser at the bottom of the bale than at the top thereof). In addition, some material, such as newspaper, tend to be very difficult to sever or shear, therefore increasing the power required for reciprocation and the energy consumption of the baler.

The second type of device designed to improve compaction in the compaction chamber generally consists of preflap arrangement. Briefly, the recycled material is fed into the compaction chamber through the opening. A preflap is actuated to close the feeding opening, forcing the material stuck in the feeding opening into the compaction chamber. This configuration tends however not to be efficient when the material to be compacted comprises large pieces of material such as, for instance, boxes of corrugated cardboard. Indeed, large recycled material tends to jam the preflap assembly and require the baler to be shut down for manual removal of stucked material.

It would therefore be advantageous to be provided with a single ram baler that overcomes at least one of the drawbacks associated with previous single ram baler configurations.

SUMMARY OF THE INVENTION

In order to address the above and other drawbacks, and in accordance with the present invention, there is disclosed a single ram baler for baling a material.

According to one embodiment of the present invention, the single ram baler comprises a horizontal housing defining a compaction chamber therein and a feeding opening defined in the housing. The feeding opening is adapted for feeding the material in the compaction chamber, which opening has a given shape. The baler also comprises a hopper mounted on the housing, around the feeding opening, for directing the material toward the feeding opening. The hopper has a cross-section corresponding to the shape of the opening.

The baler further comprises a preflap pivotably mounted on the housing, the preflap being operable to pivot in the hopper between an open position for allowing the material to travel through the opening and a close position. The preflap comprises a face having a shape corresponding to said shape of the opening for substantially closing the same when the preflap is in the close position. A preflap actuating means operable for causing the preflap to pivot between the open and close positions is also provided. The face of the preflap is adapted for forcing the material present in the hopper to move in the compaction chamber when the preflap pivots from the open position to the close position.

The baler also comprises a press ram mounted for reciprocation in the compaction chamber between a retracted position for allowing feeding of the material in the compaction chamber and an extended position for compacting the material fed in the compaction chamber. The baler also comprises a shear blades assembly. The shear blade assembly comprises at least one moving blade mounted to the ram and at least one fixed blade mounted to the housing. The at least one moving blade collaborates with the at least one fixed blade to guillotine material contained in the compaction chamber and extending through the opening when the press ram moves from the retracted position to the extended position.

A press ram actuating means is operable to cause reciprocation of the press ram in the compaction chamber between the retracted and extended positions.

According to one aspect, the material comprises a recycled material, and is preferably selected from a group consisting of paper, cardboard, plastic, metal and fabric.

According to a further aspect, the housing of the baler comprises a back end, a front end, a bottom wall, a spaced-apart top wall and a pair of side walls extending therebetween to define a rectangular cross-section extending between the back end and the front end.

According to yet a further aspect, the opening is defined on the top wall of the housing and the hopper extends upwardly from the top wall. The opening is preferably defined by a pair of side edges, a perpendicular back edge extending therebetween and a front edge, spaced-apart front the back edge and extending between the sided edges.

According to another aspect, the hopper comprises a pair of vertical side walls, each side wall being adjacent to one side edge, a front wall extending between the side walls, adjacent to said front edge, and a back wall. The back wall extends between the side walls and back wall comprising a preflap opening having a shape corresponding to the shape of the face of the preflap for allowing the preflap to pivot in the hopper between the open and close positions. When the preflap is in the open position, the face substantially closes said preflap opening.

According to one further aspect, the front edge of the opening and at least a portion of the front wall of the hopper are V-shaped.

According to another aspect, the front edge of the opening defines the fixed blade.

According to yet another aspect, the press ram comprises a frame having a front end and a back end connected to the ram actuating means. The press ram further comprises a vertical platen mounted to the front end of the frame. The platen preferably comprises a plurality of vertical grooves, the grooves being configured for receiving therethrough a corresponding plurality of needles of a vertical wire-catch assembly when the ram is in extended position and for allowing the passage of wires when the ram moves from the extended position to the retracted position.

According to another aspect, the platen further comprises a top portion, the at least one moving blade being mounted to the top portion of the platen. The at least one moving blade is preferably configured for receiving therethrough the corresponding plurality of needles of the vertical wire-catch assembly when the ram is in extended position and allowing the passage of the wires when the ram moves from the extended position to the retracted position.

According to yet another aspect, the single ram baler further comprises an extrusion channel operatively mounted to the housing. The extrusion channel is adapted for resisting the passage of the material when the press ram moves from the retracted position to the extended position, thereby allowing the material to be compacted into a bale.

The extrusion channel preferably comprises a bottom wall, a top wall and a pair of side walls, each of said walls having a back end in connection with the front end of the housing, and a front end.

According to a further aspect, least one of the walls of the extrusion channel comprises a movable wall, where the at least one movable wall is connected to the housing via a hinge assembly.

According to yet a further aspect, the hinge assembly comprises a bracket assembly on the front end of the housing, an elongated hole extending through the at least one movable wall, at the back end thereof, and a rod fixedly mounted to the bracket assembly and extending through the elongated hole for allowing movement of the back end of the at least one movable wall relative to the housing.

The extrusion channel preferably comprises a clamp assembly for causing a portion of said at the one movable wall to move between an open position and a close position, where the portion is at least one of the front end of the at least one wall and the back end of the at least one wall.

According to another embodiment, the single ram baler further comprising a wire-catch assembly operable for wiring said bale. The wire-catch assembly is preferably selected from a group consisting of a horizontal wire catch assembly and a vertical wire catch assembly.

These and other objects, advantages and features of the present invention will become more apparent to those skilled in the art upon reading the details of the invention more fully set forth below.

BRIEF DESCRIPTION OF THE DRAWINGS

Having thus generally described the nature of the invention, reference will now be made to the accompanying drawings, showing by way of illustration an illustrative embodiment thereof, and in which.

DESCRIPTION OF THE ILLUSTRATIVE EMBODIMENTS

Figure 1:
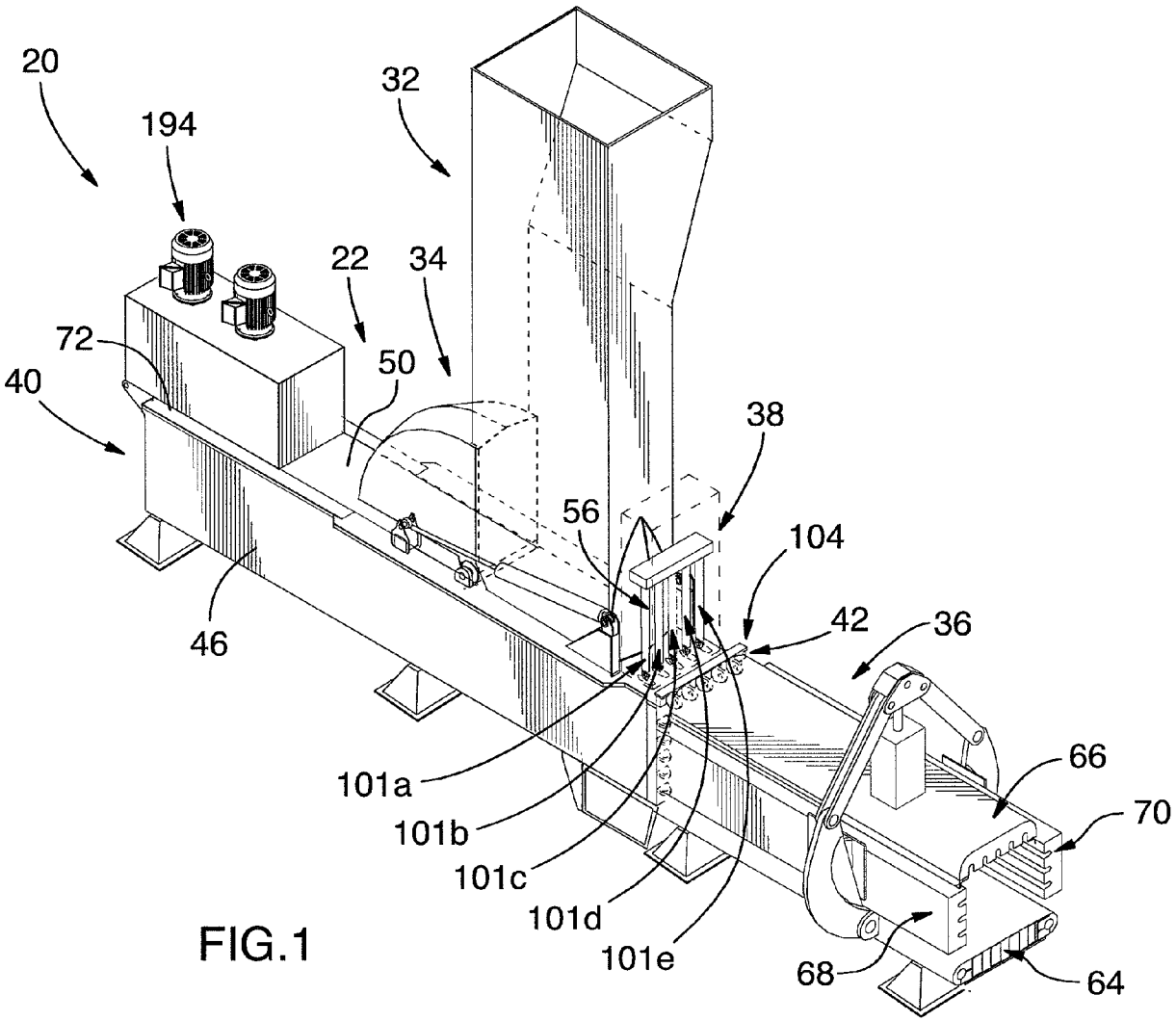
FIG. 1 is a front left perspective view of a single ram baler according to one embodiment of the present invention.

The description which follows, and the embodiments described therein are provided by way of illustration of an example, or examples of particular embodiments of principles and aspects of the present invention. These examples are provided for the purpose of explanation and not of limitation, of those principles of the invention. In the description that follows, like parts are marked throughout the specification and the drawings with the same respective reference numerals.

With reference to FIGS. 1 to 5 a single ram baler according to one embodiment of the present invention is shown using reference numeral 20. The baler 20 comprises a generally horizontal housing 22 defining an actuator chamber 24 and a downstream compaction chamber 26. Mounted for reciprocation in the housing 22 is a press ram 28 comprising a ram actuator 30, the actuator 30 being operable for driving reciprocation of the press ram 28 in the compaction chamber 26, as it will become apparent below. Provided on the housing 22 is a generally vertical feeding assembly 32 adapted for conveying the material to be baled in the compaction chamber 26. The baler 20 is further provided with a preflap assembly 34 mounted on the housing 22 and adapted to force material that may be contained in the feeding assembly 32 to move towards the compaction chamber 26 of the housing 22.

Downstream from the housing 22, the baler 20 is provided with a generally horizontal extrusion channel 36, adapted for retaining bales of compacted recycled material, thereby providing support for the build up of further bales of material, as best described below. The baler 20 further comprises a vertical wire-catch assembly 38 (shown in FIGS. 1 and 4) for wiring the bales produced upon operation of the baler 20.

The housing 22 has a generally rectangular cross-section and comprises a back end 40 and a front end 42. The housing 22 also comprises a generally horizontal base or bottom wall 44 having a pair of spaced-apart side edges 46,48 (shown in FIG. 5) and extending between the back and front ends 40,42. Extending upright along the length of the bottom wall 44, between the back and front ends 40,42, is a pair of spaced-apart side left and right side walls 50,52. The left side wall 50 has a bottom edge 54 adjacent to the left side edge 46 of the bottom wall 44, and a top edge 56. Similarly, the right wall 52 has top and bottom edges 62 and 64, respectively (shown in FIGS. 1 and 5)

Figure 6:
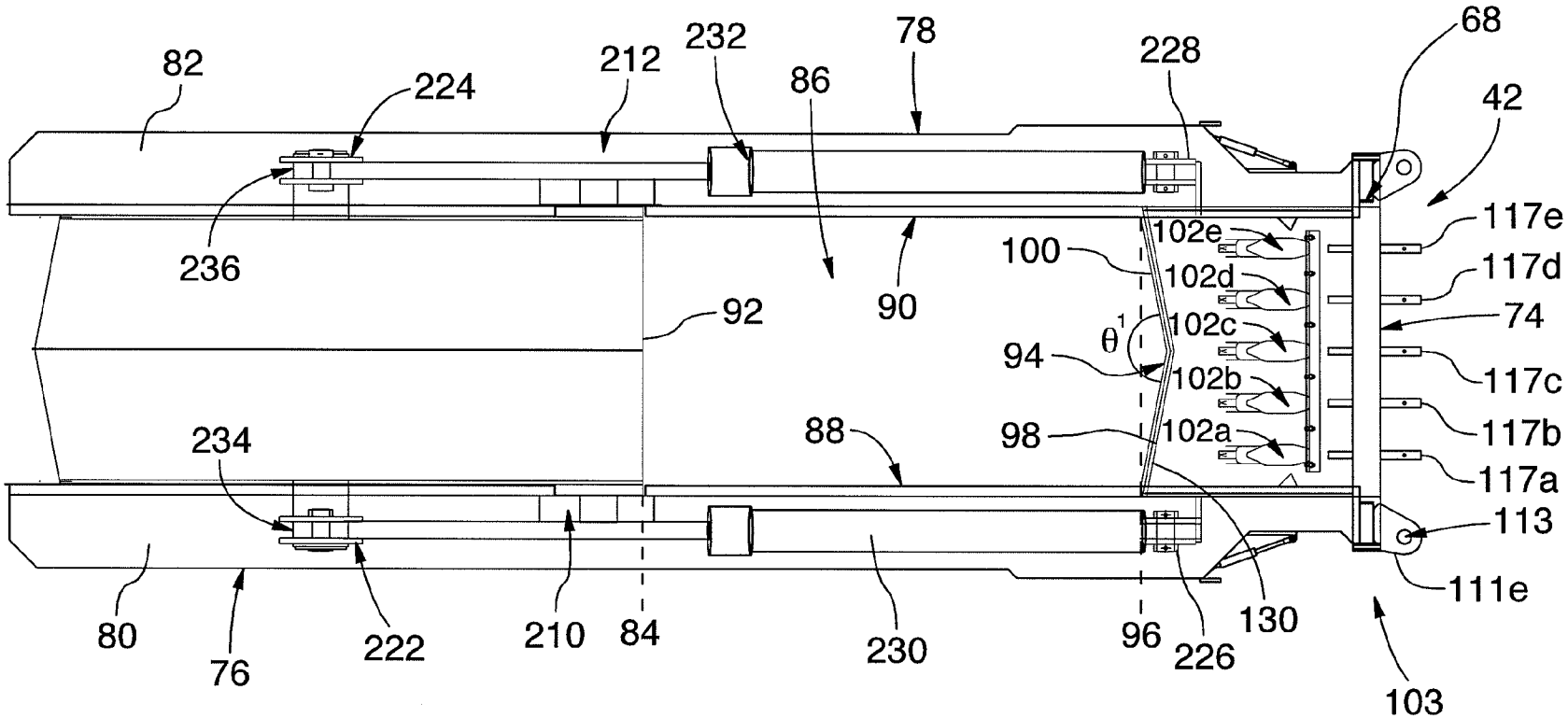
FIG. 6 is a partial top plan view of the single ram baler shown in FIG. 1, showing the preflap in open position.
Figure 7:
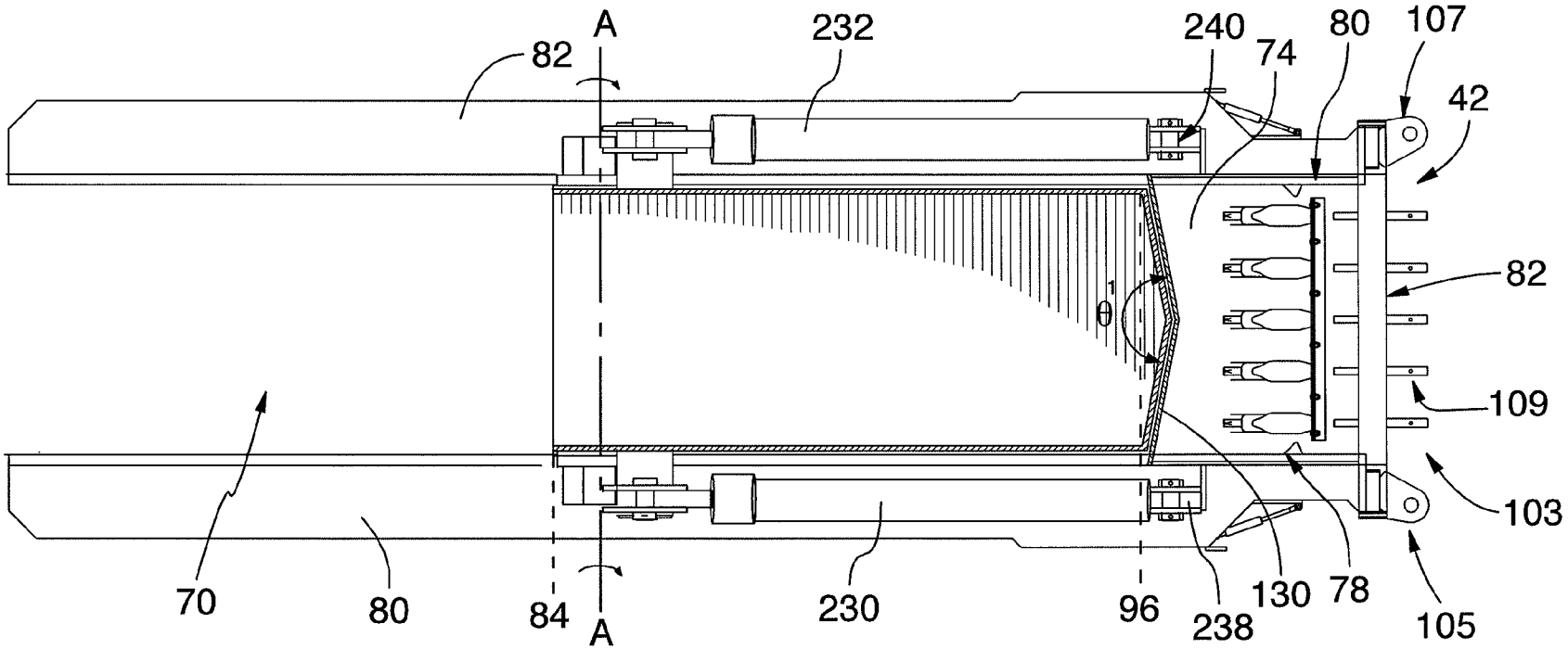
FIG. 7 is another partial top plan view of the single ram baler shown in FIG. 1, showing the preflap in close position.
Figure 8:
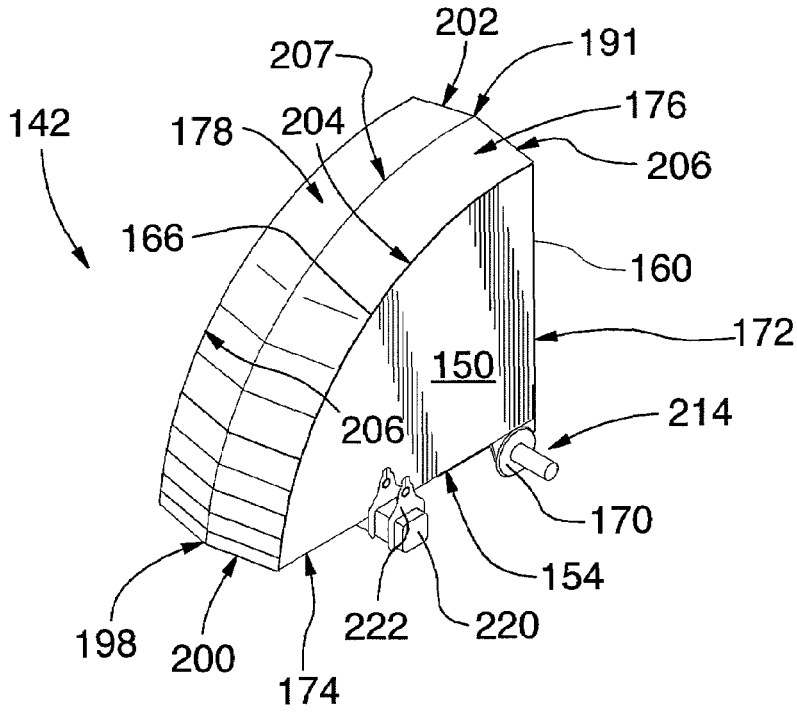
FIG. 8 is a back left perspective view of a preflap in accordance with one embodiment of the present invention.

With reference to FIGS. 1, 6 and 7, the housing 22 is further provided with a generally horizontal top wall 70 extending from the back end 40 of the housing 22 to the front end 42 thereof. The top wall 70 comprises a back edge 72 adjacent to the back end 40 of the housing 22 (FIG. 1), a front edge 74 adjacent to the front end 42 and a pair of left and right side edges 76,78 (FIGS. 6 and 7). As best shown in FIGS. 6 and 7, the side edges 76,78 of the top wall 70 protrude horizontally from each side walls 50,52 to define supporting lips 80,82.

Figure 3:
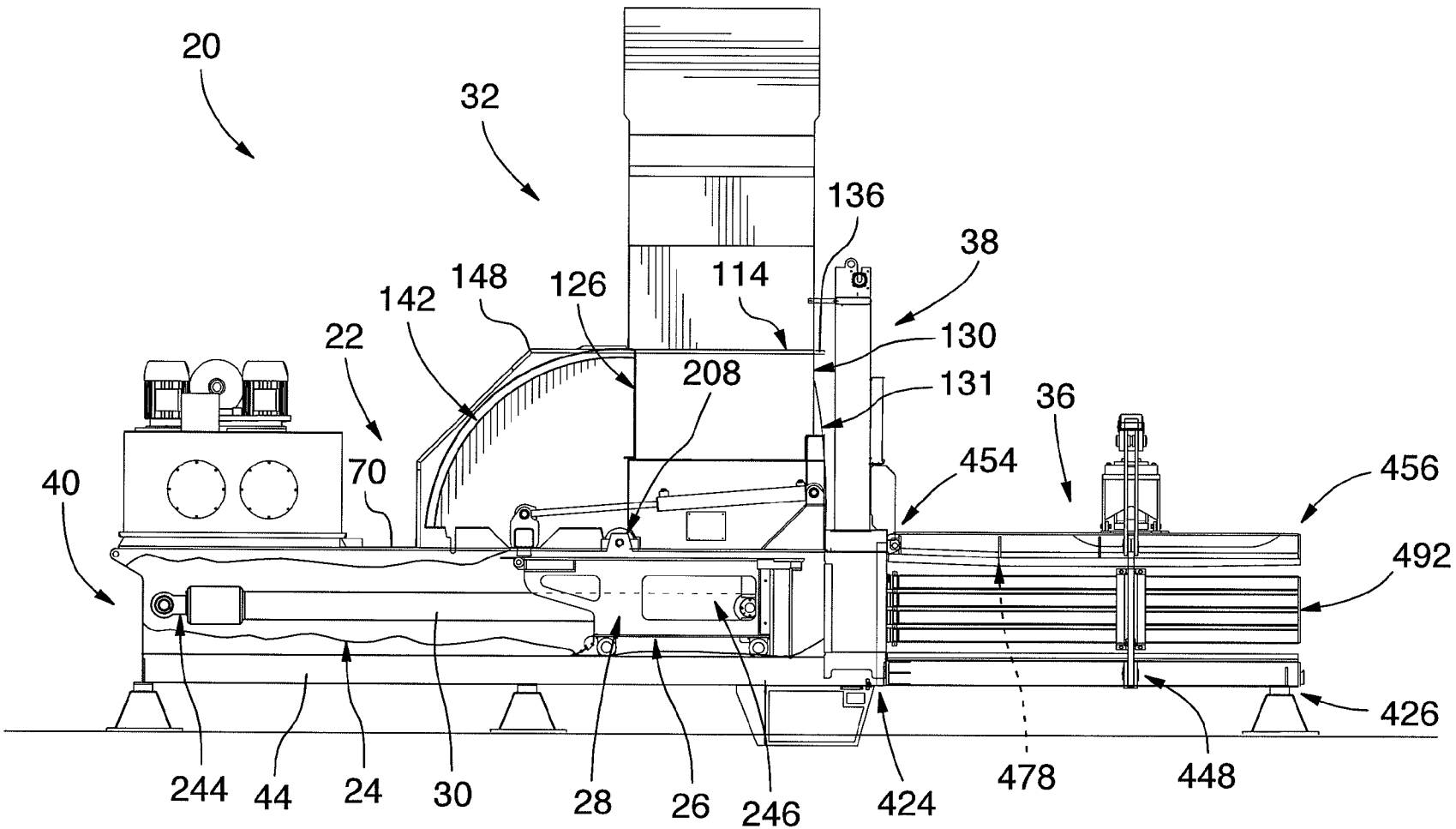
FIG. 3 is a left elevation view of the single ram baler shown in FIG. 1.
Figure 4:
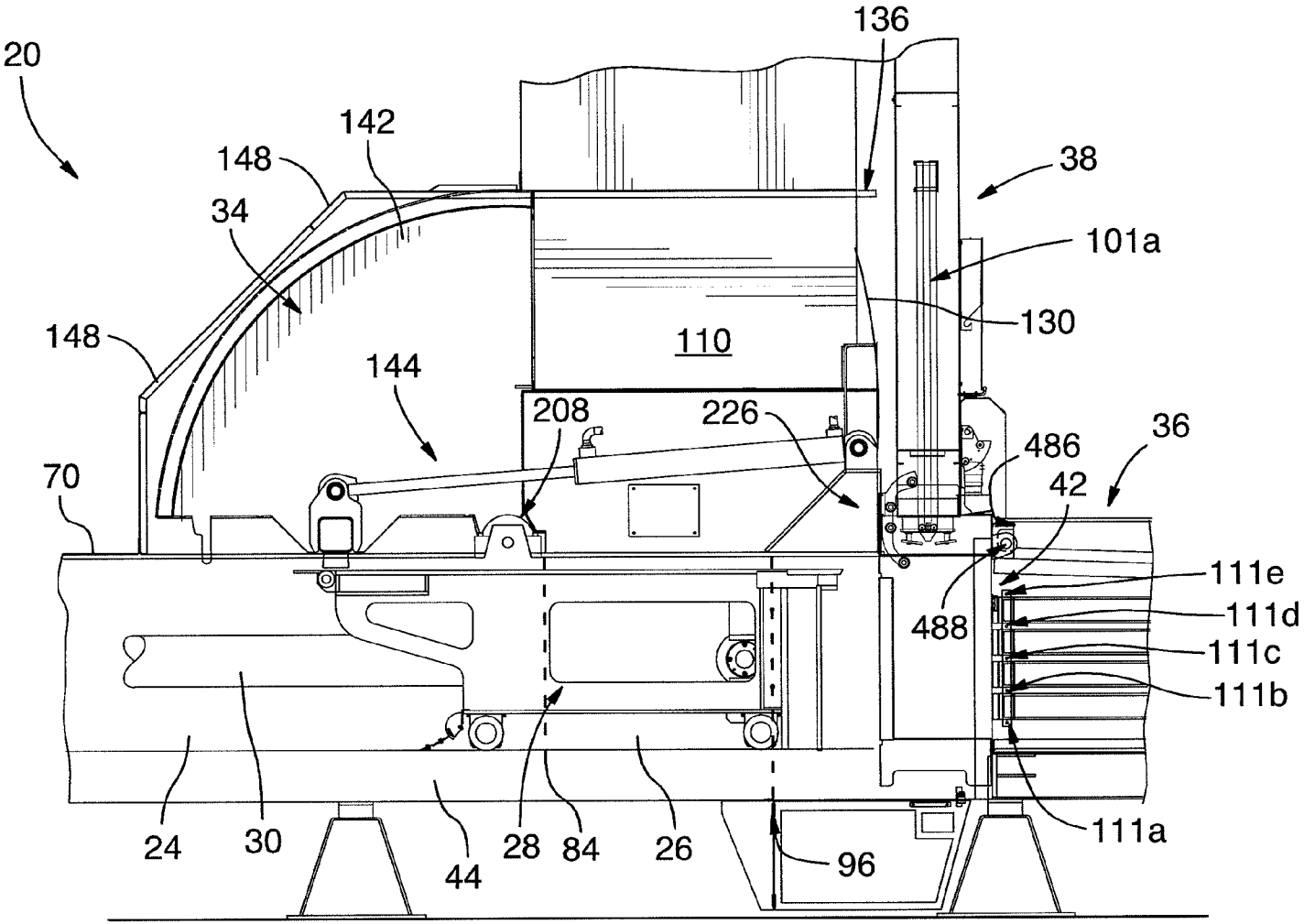
FIG. 4 is an enlarge elevation view of the single ram baler shown in FIG. 3, for better showing the junction of the housing and the extrusion channel.

Defined in the housing 22 and extending from the back end 40 to a first intermediate region 84 is the actuator chamber 24 (shown in FIGS. 3 and 4). The distance separating the back end 40 of the housing 22 and the first intermediate region 84 is adapted for receiving therein the hydraulic actuator 30. The compaction chamber 26 extends downstream from the actuator chamber 24, from the first intermediate region 84 to the front end 42 of the housing 22.

With reference to FIGS. 6 and 7, the housing 22 comprises a top or feeding opening 86, defined in the top wall 70 and adapted for allowing the passage of material therethrough, from the upstream feeding assembly 32 to the downstream compaction chamber 26, as it will become apparent below. The opening 86 is surrounded by a pair of side edges 80,90, adjacent to the top edges 60,62 of the side walls 50,56, respectively and a generally perpendicular back edge 92, extending between the side edges 88,90 at the first intermediate region 84. The opening is also surrounded by a generally V-shape edge 94, at a second intermediate region 96 located between the first intermediate region 84 and the front edge 74 of the top wall 70.

The V-shaped cutting edge 94 of the top wall 70 is provided with first and second edges 98,100 defining therebetween an angle $\theta^1$. This configuration contributes to enhance the cutting properties of the cutting edge 94 when the baler is in operation, as best described below. In one embodiment of the present invention, the angle $\theta^1$ ranges from 90° to 175°, preferably from 120° to 170° and more preferably between 150° and 160°.

Also provided on the top wall 70 is a plurality of wire-catch holes 102*a*-102*e* located between the second intermediate region 96 and the front edge 74 of the top wall 70. The wire-catch holes 102*a*-102*e* are preferably distributed evenly on the top wall 70 such that when operated, a plurality of needles 101*a*-101*e* of the wire-catch assembly 38 will go down through the front portion of the compaction chamber 26, to extend between the top and bottom walls 70,44. As such, the wire-catch holes 102*a*-102*e* are sized, shaped and positioned for receiving therein the corresponding plurality of needles 101*a*-101*e* of the vertical wire-catch assembly 38 for wiring the bales produced by the baler 20 in operation.

Still referring to FIGS. 6 and 7, a bracket assembly 103 for mounting the extrusion channel 36 to the housing 22 is mounted at the front end 42 of the housing 22. The bracket assembly 103 includes a pair of side brackets 105,107, each side brackets 105,107 being mounted to and extending from the front edge 60,68 of a corresponding side wall 50,52, and a top bracket 109 mounted to and extending from the front edge 74 of the top cutting wall 70.

Turning to FIG. 4, the side bracket 105 comprises a first horizontal plate member 111*a* located proximal to the bottom edge 54 of the wall 50, and three plate members 111*b*-111*d* distributed therebetween a second horizontal plate member 111*e* located proximal to the top edge 56 of the wall 50. As best shown in FIG. 4, the plate members 111*a*-111*e* extend frontwardly from the housing 22 and are vertically spaced apart from one another for mounting the extrusion channel 36 to the housing 22. The plate members 111*a*-111*e* each comprises a circular hole 113 (shown in FIG. 6), the circular holes 113 of the plate members 111*a*-111*e* being vertically aligned onto one another and adapted for receiving therein a mounting rod or shaft 115 as it will become apparent below. The configuration of the side bracket 107 is generally similar to the configuration of side bracket 105, with the exception of being mirror image thereof.

Returning to FIG. 6, the top bracket 109 comprises a first left, vertical plate member 117*a* located on the front edge 74 of the top wall 70, proximal to the first side edge 76, a second, right vertical plate member 117*e* also located on the top cutting wall 70, but proximal to the second side edge 78 and three (3) plate members 117*b*-117*d* distributed therebetween. The vertical plate members 117*a*-117*e* extend frontwardly from the housing 22 and are horizontally spaced apart from one another for mounting the extrusion channel 36 to the housing 22. The vertical plate members 117*a*-117*e* each comprises a circular hole (not shown), the circular holes 119 of the plate members 117*a*-117*e* being horizontally aligned onto one another and being adapted for receiving therein a mounting rod or shaft 121 as it will become apparent below.

Returning to FIGS. 1 to 4, the feeding assembly 32 comprises a preflap receiving portion 104 mounted to the top wall 70 of the housing 22, an upstream intermediate portion 106 and a further upstream hopper portion 108 adapted for receiving recycled material to be compacted from a feeder (not shown), such as a belt conveyor. Such intermediate and hopper portions 106,108 are known in the art and do not require elaborate description.

Figure 5:
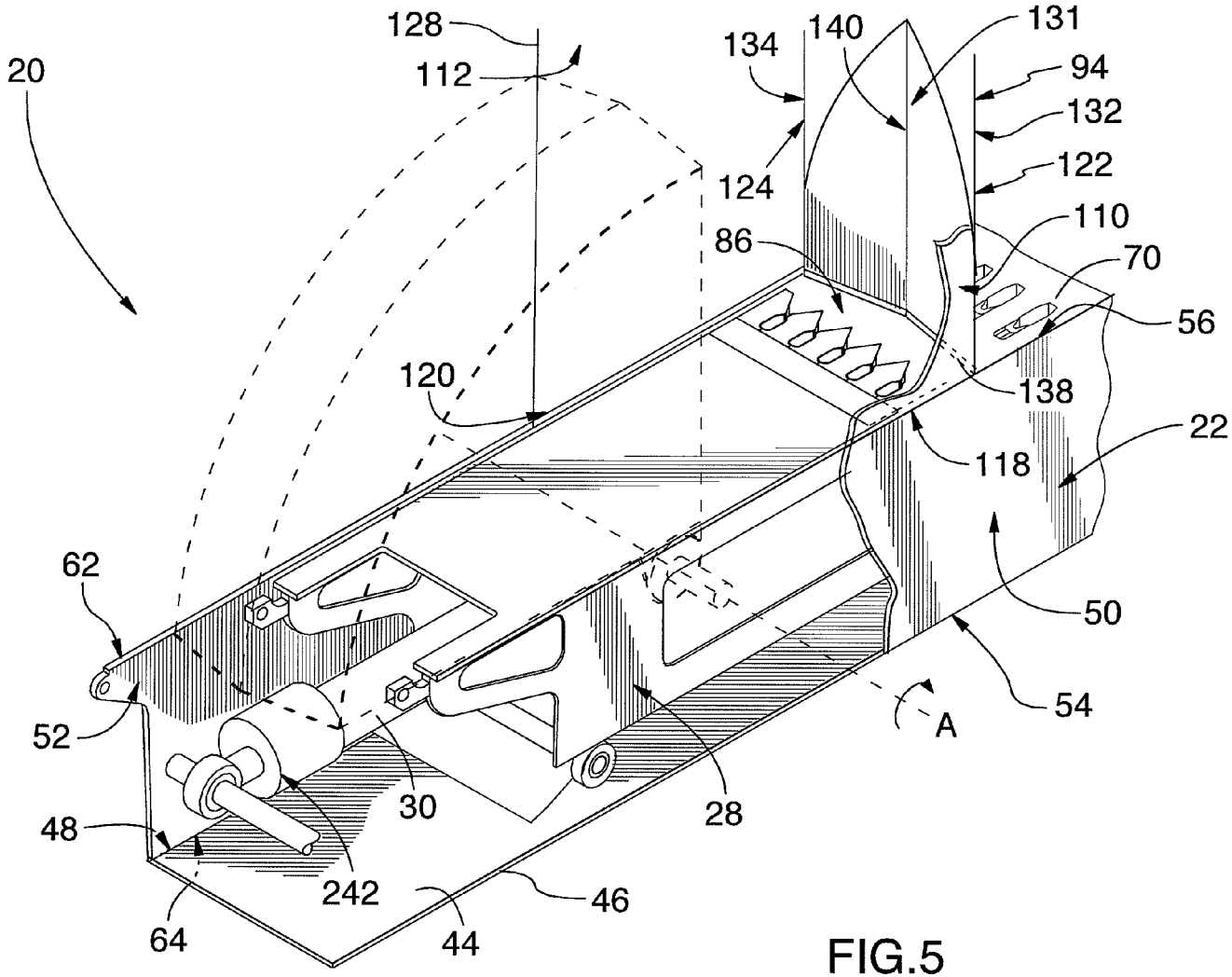
FIG. 5 is a close up, back left perspective view of the single ram baler shown in FIG. 1, with the housing and the feeding assembly partially cut out for showing the ram.

The preflap receiving portion 104 comprises a pair of spaced apart, generally rectangular side walls 110,112, extending upright from the top wall 70 of the housing 22. Each side wall 110,112 has a generally horizontal top edge 114,116 (FIG. 2) connected to the intermediate portion 106, a generally horizontal bottom edge 118,120 (FIG. 5). Each side wall 110,112 further comprises a vertical front edge 122,124 and a back edges 126,128 extending therebetween. The bottom edges 118,120 of the side wall 110,112 are aligned with and adjoin the side edges 88,90 of the opening 86, extending from the first intermediate region 84 to the second intermediate region 96 (i.e. between the back edge 92 and front edge 94 of the opening 86).

The preflap receiving portion 104 further comprises a front wall 130 extending between the side walls 110,112, at the front edges 122,124 thereof. The front wall 130 includes a pair of side edges 132,134 adjoining and extending vertically along the front edges 122,124 of the side walls 110,112, respectively. The front wall 130 is also provided with top and bottom edges 136,138 extending therebetween (shown in FIGS. 4 and 5). The front wall 130 also comprises a generally V-shaped extension 131 protruding frontwardly (i.e. toward the front end 42) for receiving therein a portion of the preflap assembly 34, as it will become apparent below (best shown in FIGS. 6 and 7). The extension 131 comprises a curved, offset center line 140. The top and bottom edges 136,138 extend from the side edges 132,134 of the wall 130 toward the offset center line 140 to define the V-shape terminating in a tip 133. The V-shape of the extension 131 generally corresponds to the V-shape of the cutting edge 94 and the wall 130 is preferably mounted to the top wall 70 for such V-shaped extension to be aligned with the V-shape edge 94 of the top wall 70. As it will become apparent below, this configuration of the front wall 130 enables the preflap assembly 34 to operate in the preflap receiving portion 104, while avoiding material of the feeding assembly 32 to unwantedly lodge on the top wall 70 within, in the preflap receiving portion 104.

At the back end thereof, the preflap receiving portion 104 comprise a preflap opening (not shown) sized and shaped for allowing operation of the preflap assembly 34, at is will become apparent below.

Now turning to FIGS. 4 and 8 to 12, the preflap assembly 34 will be described. In one embodiment, the preflap assembly 34 comprises a preflap 142 pivotably mounted on the housing 22 along a horizontal axis A-A (shown in FIGS. 1 and 5). The preflap 142 is adapted for moving in the feeding assembly 32 and for closing the feeding opening 86, as it will become apparent below. The preflap assembly 34 also comprises an actuator assembly 144 for causing the preflap to move between a close position (best shown in FIGS. 22C to 22E) and an open position (best shown in FIGS. 21A-21D and 22A-22B). In one embodiment of the present invention, the preflap assembly 34 further comprises a preflap housing 148 mounted to the feeding assembly 32 and to the top wall 70 of the housing 22 for avoiding labor accidents that may occur when the preflap 142 is moved between the open and close positions.

In one embodiment of the present invention, the preflap 142 comprises a pair of spaced apart side faces 150,152, each side face 150,152 generally defining somewhat of a quadrant of a first circle having a radius $R^1$. Each side face has a back edge 154 having top and bottom ends 156,158 (when the preflap is in close position), a bottom edge 160, generally perpendicular to the back edge 154. The bottom edge 160 has a back end 162 connected to the bottom end 158 of the back edge 154, a front end 164 and a curved edge 166 extending between the top end 156 of the back edge 154 and the front end 164 of the bottom edge 168 (when the preflap is in close position). In one embodiment, the bottom back and bottom edges 154,160 of the side faces 150,152 have a length corresponding generally to the radius $R^1$ (shown in FIG. 12).

Figure 9:
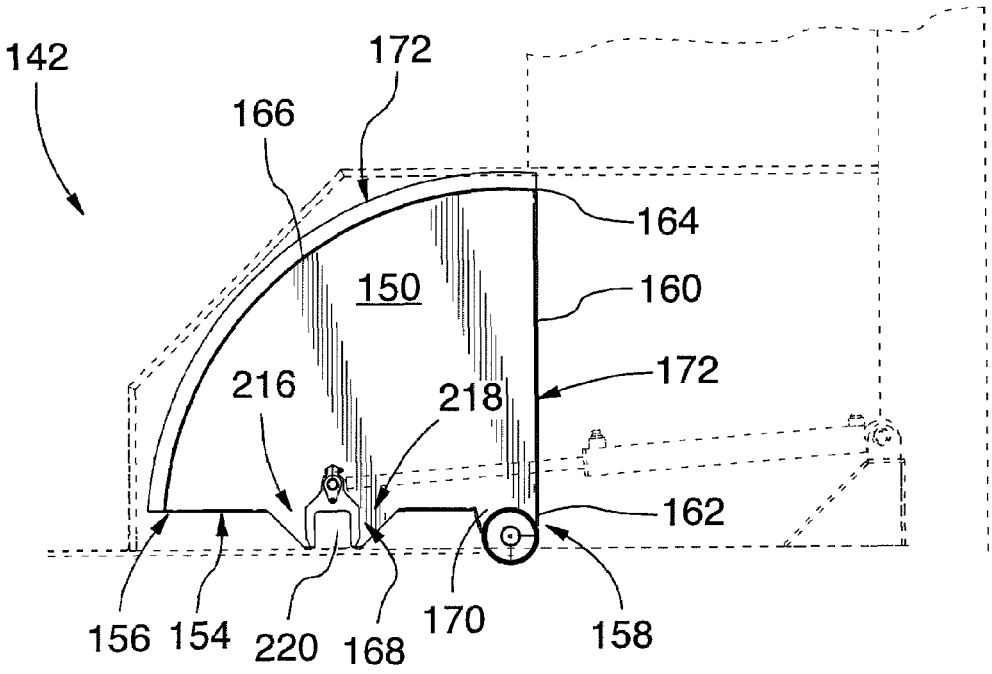
FIG. 9 is a left elevation view of the preflap shown in FIG. 8.
Figure 11:
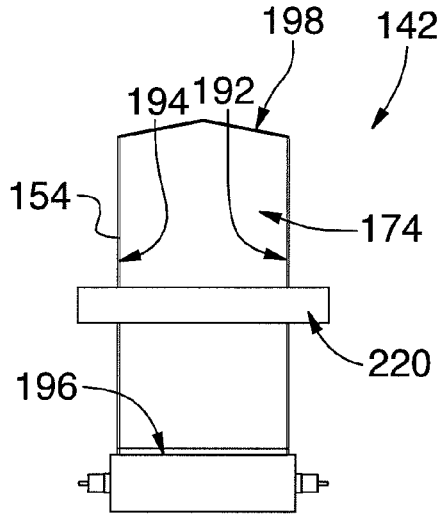
FIG. 11 is a back elevation view of the preflap shown in FIG. 8.
Figure 12:
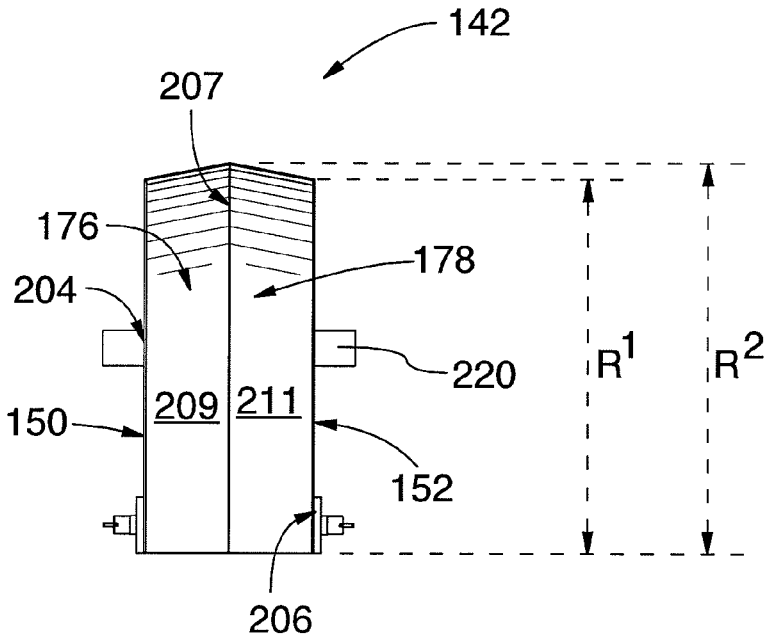
FIG. 12 is a top plan view of the preflap shown in FIG. 8.
Figure 13:
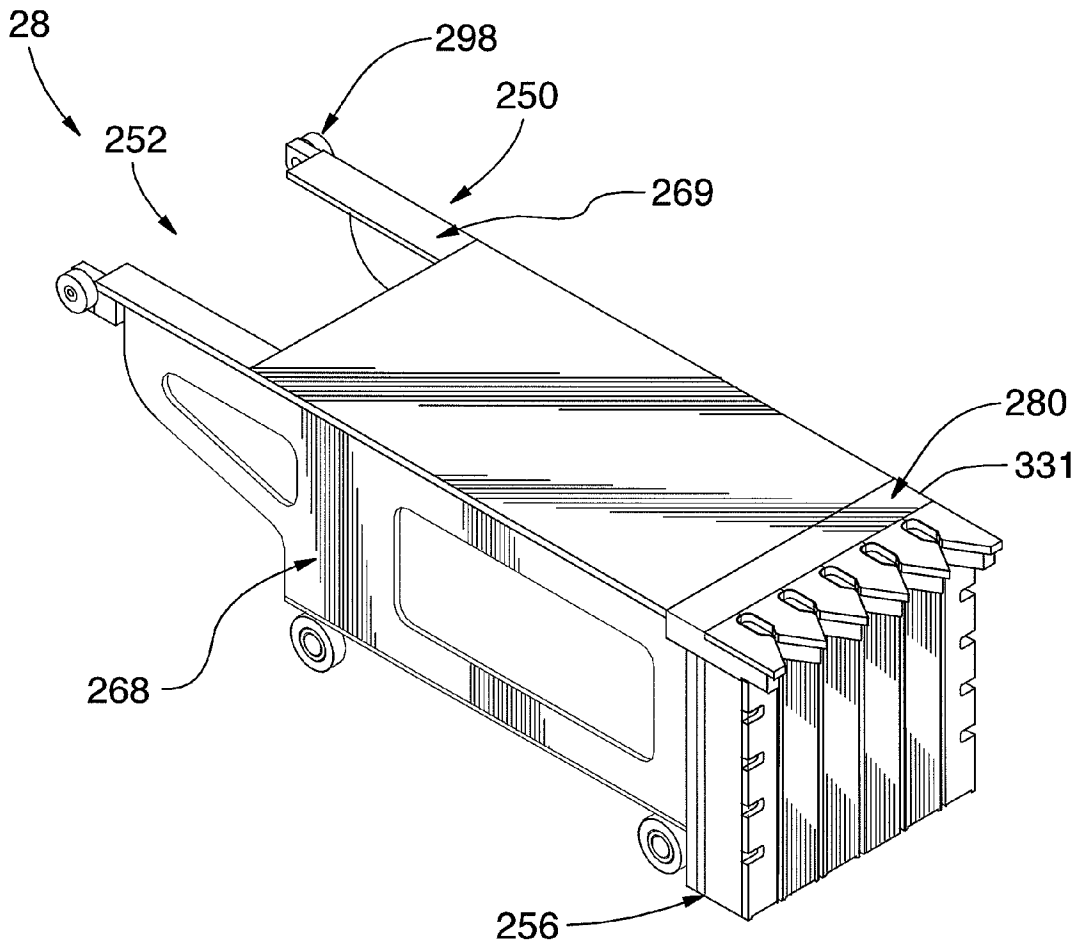
FIG. 13 is a front left perspective view of a ram according to one embodiment of the present invention.

As best shown in FIGS. 9 and 11, the back edges 154 of the side faces 150,152 define a first, actuator mounting bracket 168, generally halfway between the top and bottom ends 156,158 and a second, pivot mounting bracket 170 in the vicinity of the bottom ends 158. In one embodiment, the actuator and mounting brackets 168,170 protrude from the back edges 154.

The preflap 142 also comprises a bottom face 172, a generally perpendicular back face 174 and a pair of arcuate faces 176,178. In one embodiment, the bottom face 172 is sized and shaped for closing the opening 86 of the housing 22 when the preflap 142 is in close position. In this embodiment, the bottom face 172 has a pair of space-apart side edges 180,182, a back edge 184 extending between the side edges 180,182 perpendicularly thereto and a generally V-shaped front edge 186. The side, back and front edges 180-186 of the bottom face 172 match the corresponding side, back and front edges 88-94 of the opening 86. As such, the front edge 186 comprises a first front edge 188 and a second front edge 190, both the first and second front edges 188,190 connecting one another with an angle $\theta^2$ to define a tip 191. In one embodiment, the angle $\theta^2$ ranges from 90° to 175°, preferably from 120° to 170° and more preferably between 150° and 160°.

Figure 10:
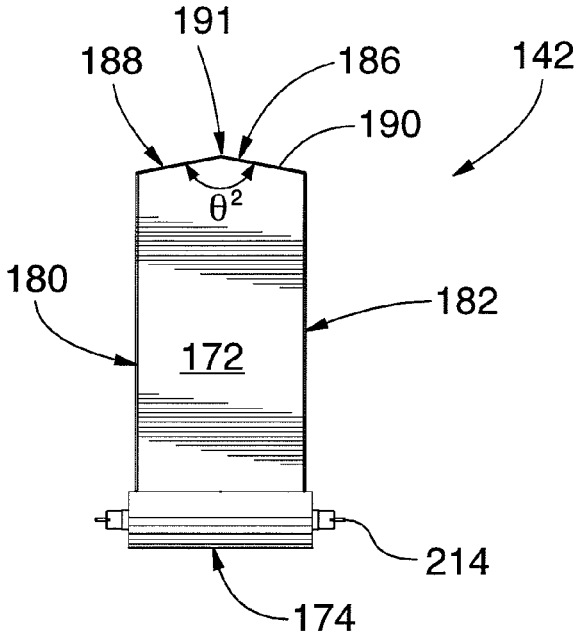
FIG. 10 is bottom plan view of the preflap shown in FIG. 8.

Similarly to the bottom face 172, the back face 174 comprises a pair of spaced-apart side edges 192,194, a generally linear bottom edge 196 extending perpendicular to the side edges 192,194 at the bottom ends thereof and a generally V-shaped top edge 198 also defining a tip 199 having the angle $\theta^2$ (FIG. 10).

The presence of the angle $\theta^2$ on the top edge 198 of the back face 174, respectively, increases the distance separating the bottom edge 196 and the top edge 198, at this location. As such, the radius of the preflap at this location is longer than the radius $R^1$ and corresponds to a radius $R^2$ (best shown in FIG. 11).

The arcuate face 176 defines an arch of a circle and comprises a top back edge 200 adjacent to the top edge 198 of the back wall 174, a bottom, front edge 202, adjacent to the front edge 190 of the bottom face 172 and a pair of arcuate side edges 204,206. The arcuate side edges 204,206 are curved and sized to adjoin and extend along the curved edges 166 of the side plates 150,152, respectively. The arcuate face 176 further comprises a centerline 207, extending between the tips 191 and 198 of the bottom and back plates 172,172, respectively, generally halfway between the side edges 204, 206. The centerline separates the arcuate face 176 into 2 mirror images, portion 209,211. At any radial position, the portions 209,211 define between each other an angle which corresponds to the angle $\theta^2$ of the top and front edges 190, 198.

Extending between the side faces 150,152 of the preflap 142 and connecting the back, bottom, side and arcuate faces 174,172,150,152,176 is a plurality of cross-members, aimed at maintaining the structure integrity and providing strength to the preflap (not shown).

As it will be appreciated by a person skilled in the art, the front edge 94 of the opening 86, the front edge 186 of the bottom face 172 of the preflap 142 and the extension 131 of the wall 130 have a V-shaped matching configuration for allowing closing of the opening 86 while reducing the efforts involved in shearing material. More specifically, the movement of the ram 28 inside the compaction chamber 26 will cause the material extending in the feeding assembly 32 to be severed upon alignment of the ram 28 and the edge 94. Due to the V-shape configuration of the edge 94, the material is gradually severed as the ram 28 continues its course to the extended position, rather than being sheared at once, such as with generally linear edges. The V-shape configuration thereby reduces the shear force required, and tends to reduce energy consumption of the baler 20. A person skilled in the art will appreciate that other matching configurations of the opening 86, the preflap 142 and the edge 94 may also fit the purpose of the invention. For instance, the edge 94 could be a straight, angular edge, a curved edge, a stair-configuration edge and the like, where the feeding assembly and the preflap 142 are adapted to match such a configuration.

With reference to FIGS. 3, 4, 6 and 7, the preflap 142 is mounted to the housing 22 through a pivot assembly 208. The pivot assembly 208 comprises a pair of pivot brackets 210, 212 mounted on the lips 80,82 of the top wall 70. As best shown in FIG. 6, the brackets 210,212 are each mounted beside a corresponding side edge 88,90 of the opening 86, slightly behind the back edge 92 thereof. This configuration allows the bottom face 172 of the preflap 142 to be in a vertical position when the preflap 142 is in open position and to close the opening (not shown) of the preflap receiving portion 104, thereby leaving a fee access to the opening 86. The pivot assembly 208 further comprises a cylindrical shaft 214 extending along the rotation axis A-A, from the first pivot bracket 210 of the housing 22 to the second bracket 212 thereof, through the pivot bracket 170 of the preflap 142 (shown in FIGS. 8 and 10). In one embodiment, the pivot assembly 208 is also provided with bearing (e.g. roller bearings, ball bearings, thrust bearing, ball pivot and the like) for facilitating rotational movement of the preflap 142 along axis A-A. A person skilled in the art will appreciate that in pivot mean could be substituted to the pivot assembly 208 as described herein. For instance, a preflap mounted on a lever assembly could be provided.

Returning to FIGS. 8, 9 and 11, the actuator mounting brackets 168 are defined by the back edges 154 of the side faces 150,152, as stated above. More specifically, each mounting bracket 168 comprises a pair of spaced apart legs 216,218 defining a generally square recess therebetween. Mounted in the recess of the brackets 168, is a generally square cross-section, elongated, cross-member 220. The cross member 220 slightly protrude from each side faces 150,152 of the preflap 142 for receiving thereon actuator brackets 222,224 (shown in FIGS. 6 and 7).

In one embodiment, the actuator assembly 144 includes a pair of housing mounting brackets 226,228 mounted on the lips 80,82 of the top wall 70, proximal to the front edge 82 of the wall 70, respectively, and a pair of hydraulic actuators 230,232 (FIGS. 6 and 7). Each actuator 230,232 is connected by a first end 234,236 to the actuator mounting bracket 222, 224 of the preflap 142 and by a second end 238,240 to the housing mounting bracket 226,228, on each side of the preflap 142. The actuator assembly 144 further comprises hydraulic hoses (not shown) for connecting the hydraulic actuator to a pump (not shown) driven by an electric motor 242 (shown in FIG. 1). The pump and the electric motor 242 allow the hydraulic actuators 230,232 to move between the extended position (shown in FIGS. 21A and 21B) and a retracted position (shown in FIGS. 21C and 21E). Because one hydraulic actuator 230,232 are rotatably connected to the brackets 210 and 226 or 212 and 228, movement thereof from are retracted position to the extended position will cause the preflap 142 to move from the close position to the open position. At the opposite, when the actuator moves from the extended position to the retracted position, it will cause the preflap to move from the open position to the close position. A person skilled in the art will appreciated that, depending on the position of the hydraulic actuators 230,232, moving the actuators 230,232 from the extended position to the retracted position may cause the preflap 142 to move from the close position to the open position. This would be the case, for instance, where actuator mounting brackets 226,228 of the housing 22 would be mounted behind the preflap 142 (i.e. between the location of the preflap 142 and the back end 40 of the housing 22. This person skilled in the art will further appreciate that any other actuating means could substitute the hydraulic actuators 230,232 such as, for instance, air actuator, gear and sprocket assemblies, cables, endless screws and the like.

Now turning to FIGS. 3 and 12 to 17, the compaction press 28 of the baler 22 will be described. The compaction press 22 comprises the generally horizontal hydraulic actuator 30 the actuator 30 having a back end 244 mounted to the side walls 50,52 of the housing, proximal to the back end 40 thereof, and a front end 244 (shown in FIG. 3). The compaction press 28 also comprises a ram 248 mounted to the front end 246 of the hydraulic actuator 30 for reciprocation in the press chamber 24 and the compaction chamber 26, between an extended position (best shown in FIGS. 21C and 22E) and a retracted position (best shown in FIGS. 21A and 22A).

Operatively connected to the hydraulic actuator 30 via hydraulic hoses is a hydraulic pump (not shown), driven by the electric motor 242. The electric motor 242 and the hydraulic pump (not shown) control actuation of the hydraulic actuator 30 between the extended position (i.e. toward the front end 42 of the housing 22) and the retracted position (i.e. toward the back end 40 of the housing 22). A person skilled in the art will appreciate that the hydraulic actuator 30 could be substituted by any other mechanical or pneumatic actuation or reciprocation means allowing reciprocation of the press ram 28 between the extended and retracted positions. The hydraulic actuator 30 could be replaced, for instance, by an actuator driven by endless screw, rack and pinion, chain and sprocket, belt and sprocket cable and pulley or cam mechanisms. A person skilled in the art will further appreciate that the actuator mechanism, strength and power thereof can be adapted according to the amount of material to be compacted, as well as the size and density of the bales to be provided. In one embodiment, the actuator 30 has a capacity ranging from 10 to 500 metric tons, and preferably between 50 and 300 metric tons, and even more preferably between 100 and 200 metric tons.

Now turning to FIGS. 13 to 17, the ram 28 comprises a frame 250 having a back end 252 directed toward the back end 40 of the housing 22 and a front end 254. Mounted to the front end 254 of the frame 250 is a generally vertical platen 256, which will be described in greater details below.

Figure 15:
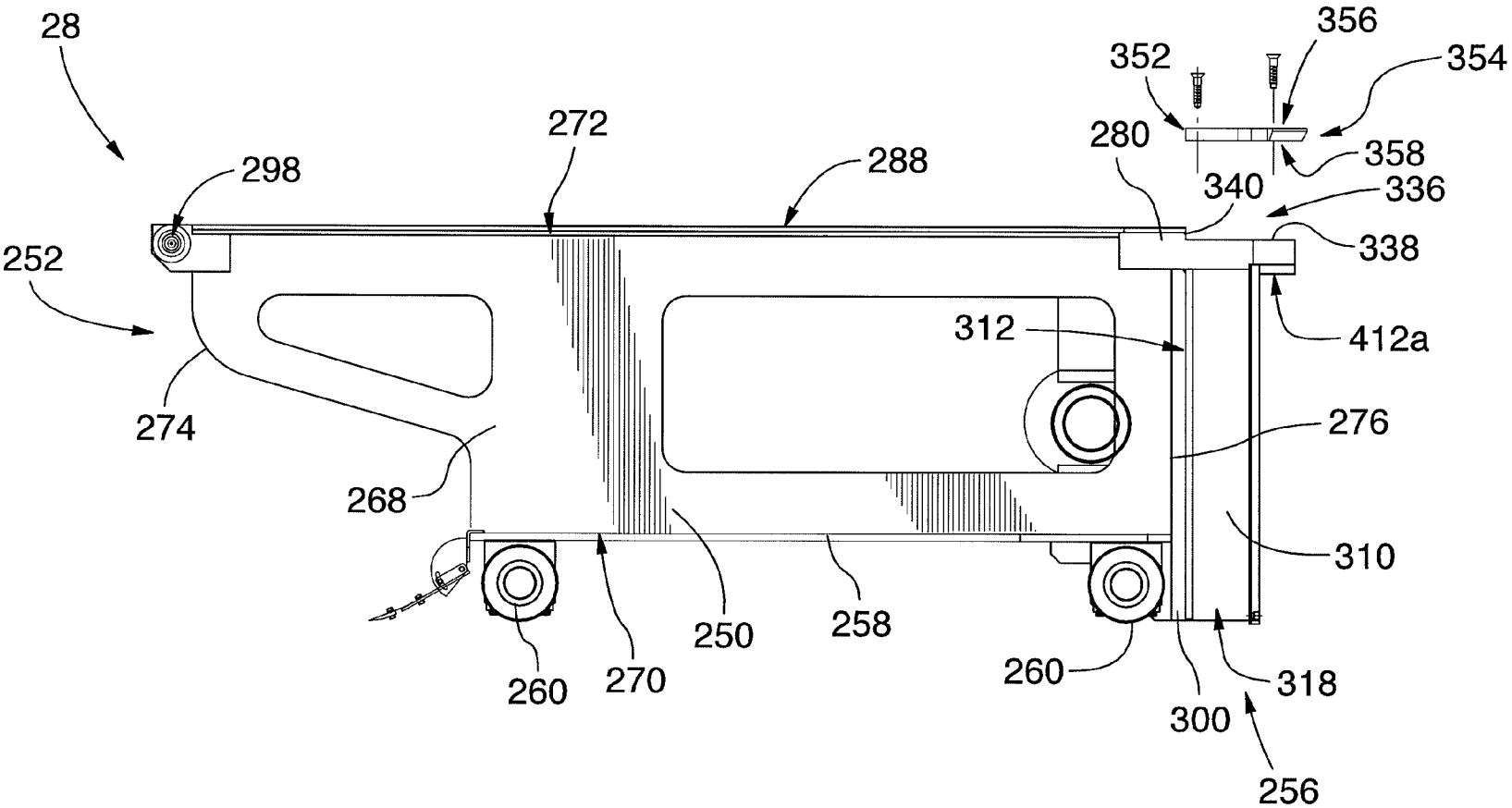
FIG. 15 is a left elevation view of the ram shown in FIG. 12.
Figure 16:
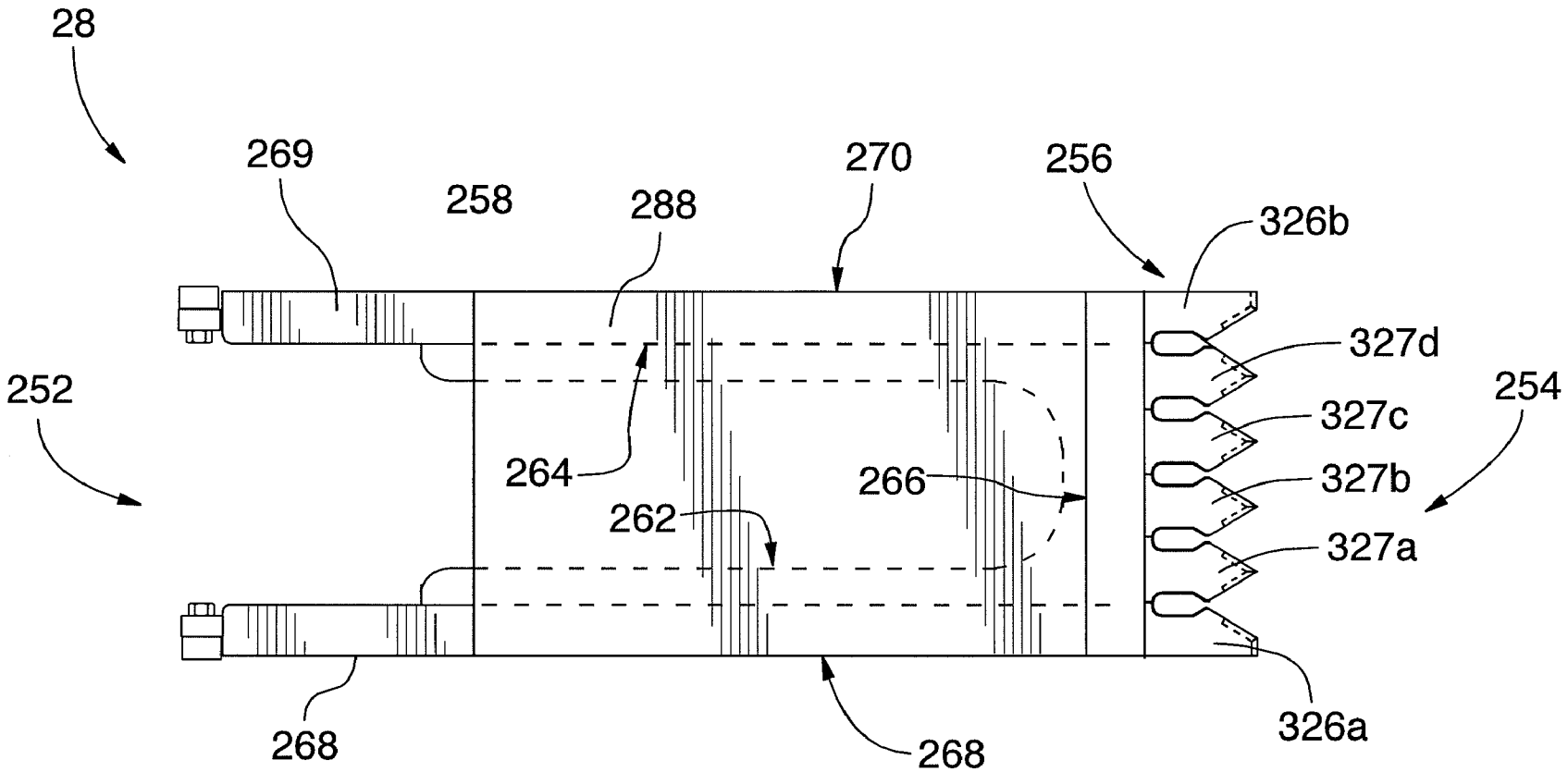
FIG. 16 is a top plan view of the ram shown in FIG. 12.

The frame 250 is provided with a generally U-shaped, horizontal, bottom member 258 mounted on steel wheels 260 and having a pair of side edges 262,264 and a front edge 266. The frame 250 also comprises a pair of spaced-apart side members 268,269 extending upright from the side edges 262, 264 of the bottom member 258. Each side member 268,269 includes a horizontal bottom edge 270, adjacent to one side edge 262 or 264 of the bottom member 258, a horizontal top edge 272 and back and front edges 274,276 extending therebetween. As best shown in FIG. 15, the front edge 276 of the side members 268,269 is vertically aligned with the front edge 266 of the bottom member 258. The top edges 272 of the side members 268,269 being longer than the bottom edges 270 thereof, the top portion of the side members 268,269 protrude toward the back end 40 of the housing 22 when the ram 248 is mounted therein. Therefore, the back end 252 of the frame 250 tends to taper from the top toward the bottom.

On the top portion of each side member 268,269, at the front end thereof, is defined a recess 278 for receiving a blade mounting plate 280. The recesses 278 each have a bottom edge 282 extending perpendicular to the front edge 276 of the side member 268,269 and a back edge 284, extending perpendicular to and between the bottom edge 282 of the recess 278 and the top edge 272 of the side member 268,269. Together, the recesses 278,279 and the cross-members define a seat 286 for the blade mounting plate 280.

Figure 14:
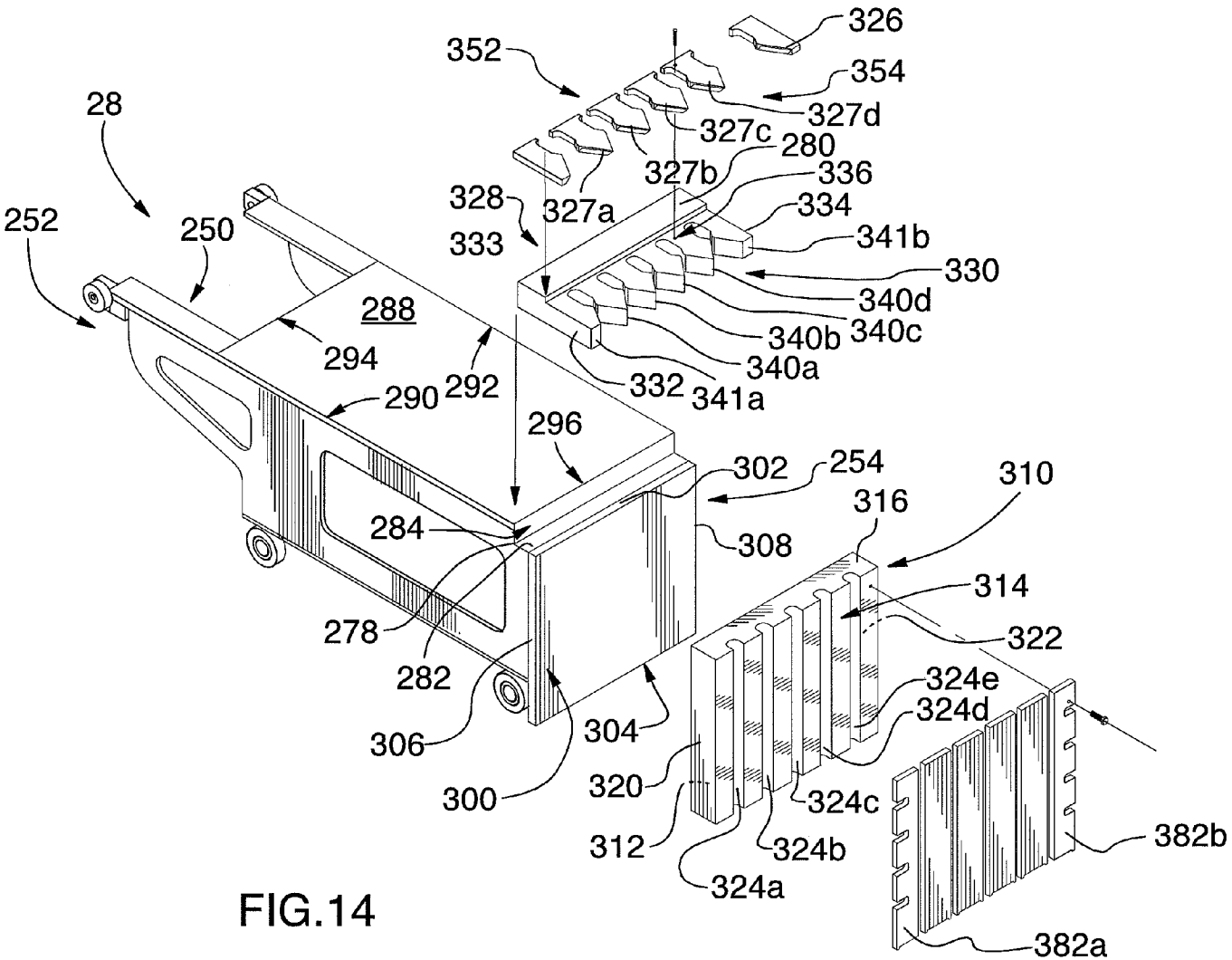
FIG. 14 is a front left perspective view of the ram shown in FIG. 12, with the platen partially exploded for clarity.

Mounted to and extending between the side members 268, 269 is a top plate member 288. Referring to FIG. 14, the top plate member 288 has a pair of side edges 290,292 adjacent to the top edges 272 of the side members 268,269, a back edge 294 and a front edge 296. The front edge 296 is aligned with the back edge 284 of the recesses 278,279, therefore allowing vertical access for placing the blade mounting plate 289 in the seat 286. Together, the bottom, side and top plate members 258,268,269 and 288, define a generally rectangular cross-section sized to fit in the press channel 24 and the compaction chamber 26 of the housing 22.

Figure 21A:
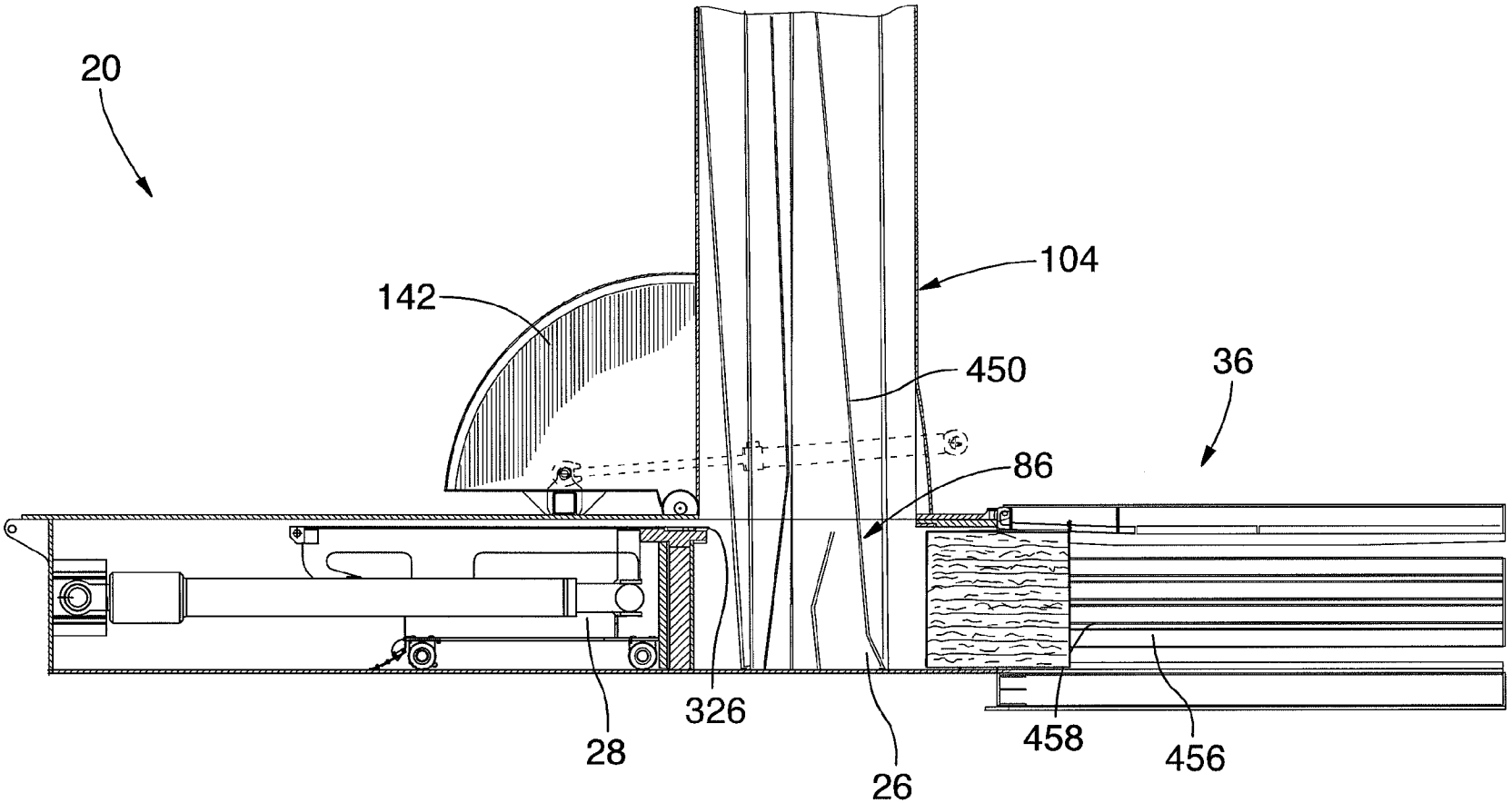
FIGS. 21A to 21D illustrate a single ram baler in operation according to one embodiment of the present invention.
Figure 21B:
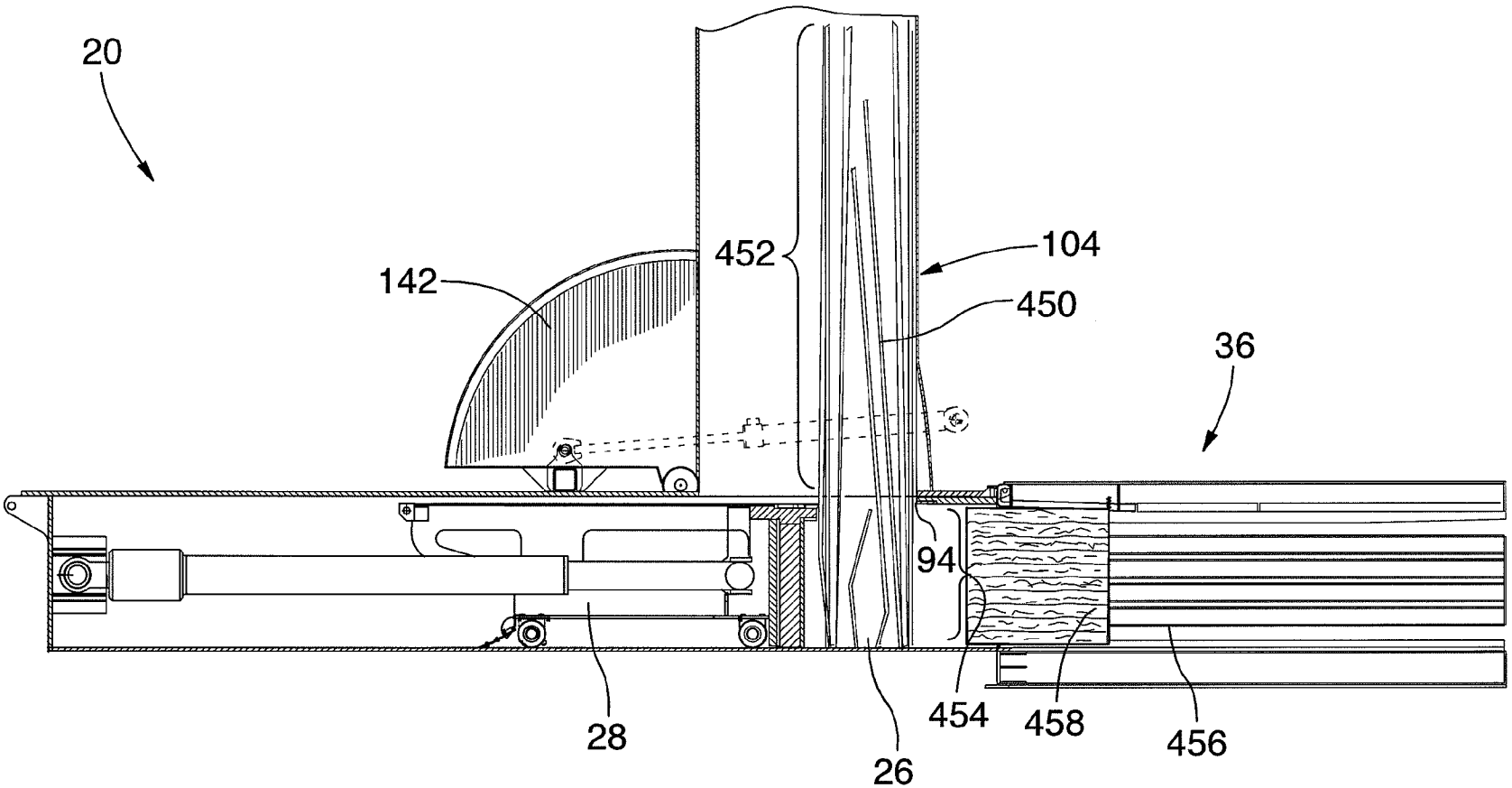
Figure 21C:
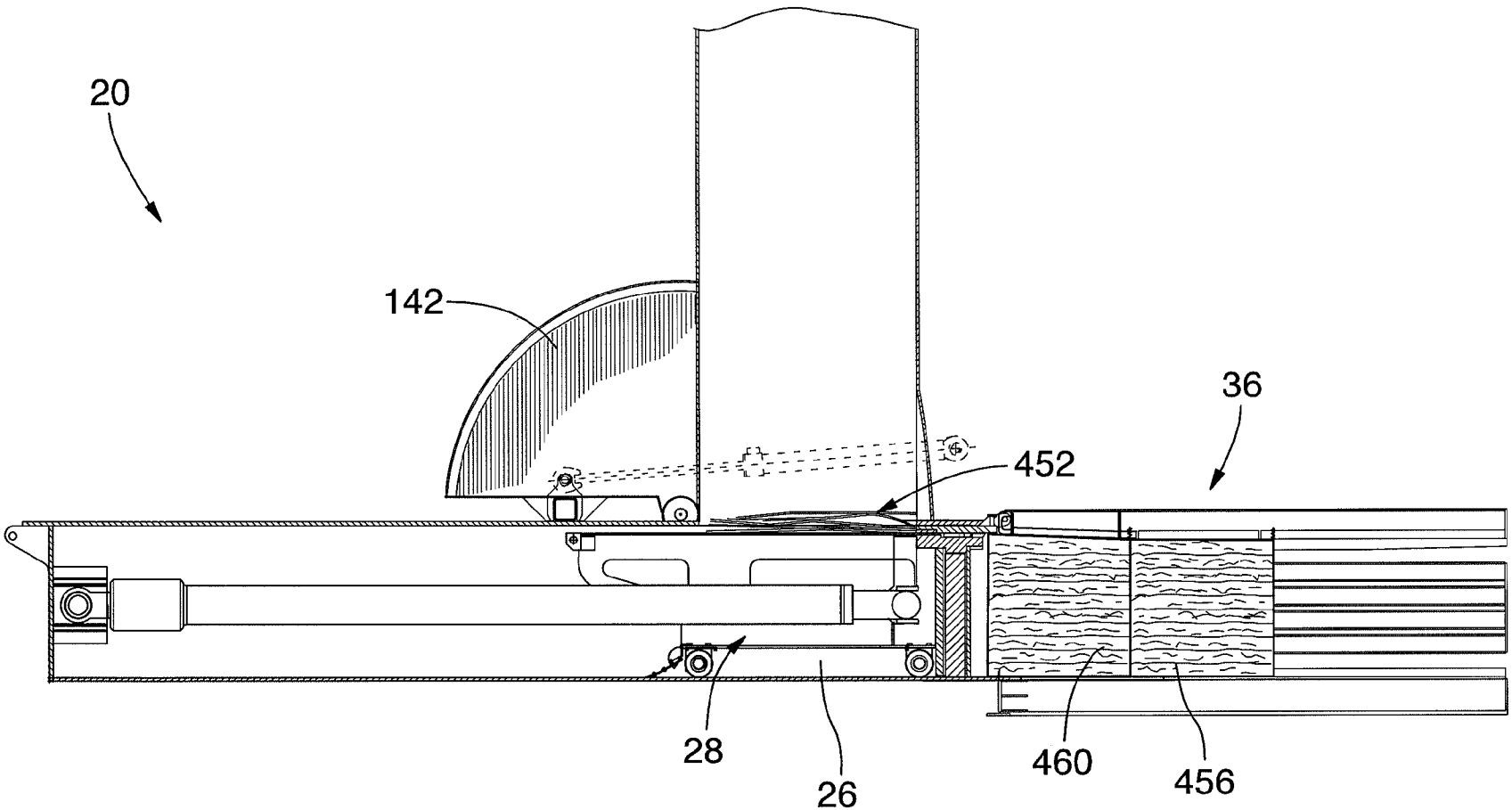
Figure 21D:
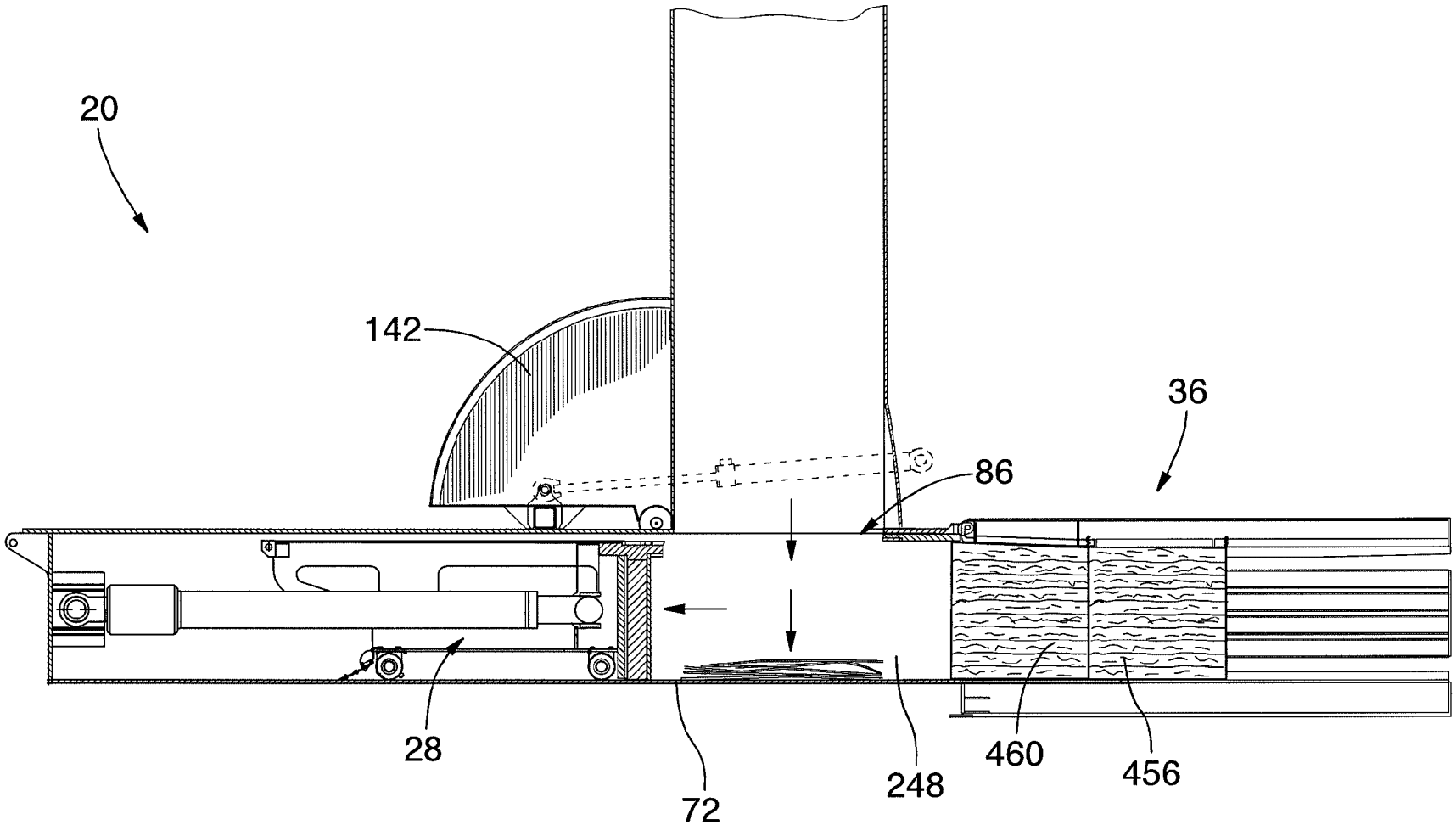

As it will become apparent below, length of the top plate member 288 is sized slightly longer than the opening 86 of the housing 22. In other words the distance separating the back and front edges 294,296 of the top plate member 288 is slightly longer than the distance separating the back and V-shaped edges 92,94 of the opening 86. This configuration permits avoiding recycled material that may be found in the feeding assembly 32 to fall behind the ram 248 when the pre-flap 142 is in open position and the compaction press is in extended position. This would be the case, for instance, when large cardboard are compacted and the portion of the cardboard extending in the preflap 142 receiving portion, as best shown in FIG. 21C and described in greater details below.

The back end 252 of the side frame members 268,269, comprises a set of wheels or rollers 298 extending slightly above the top plate members 288. The rollers 298 are aimed to contact the top wall 70 of the housing 22 for providing a minimal space between the top plate member 288 and the top wall 70 during operation of the baler 20 to reduce frictional engagement that could occur since the back end 252 may tend to move upwardly, toward the top wall 70 during compaction of recycled material.

Mounted to the front edges 266,276 of the bottom and side members 258,268,269 is a generally vertical front plate 300 (shown in FIGS. 14 and 15). The front plate 300 has a top edge 302 horizontally aligned with the bottom edge 282 of the recess 278 to provide horizontal access to the seat 286, a bottom edge 304 and side edges 306,308 extending therebetween. As best shown in FIG. 15, the bottom edge 304 front plate 300 extends below the bottom frame member 268, the bottom edge thereof 304 being proximal to the bottom wall 44 of the housing 22 when the ram 248 is in position in the press channel 24 and the compaction chamber 26.

Figure 17:
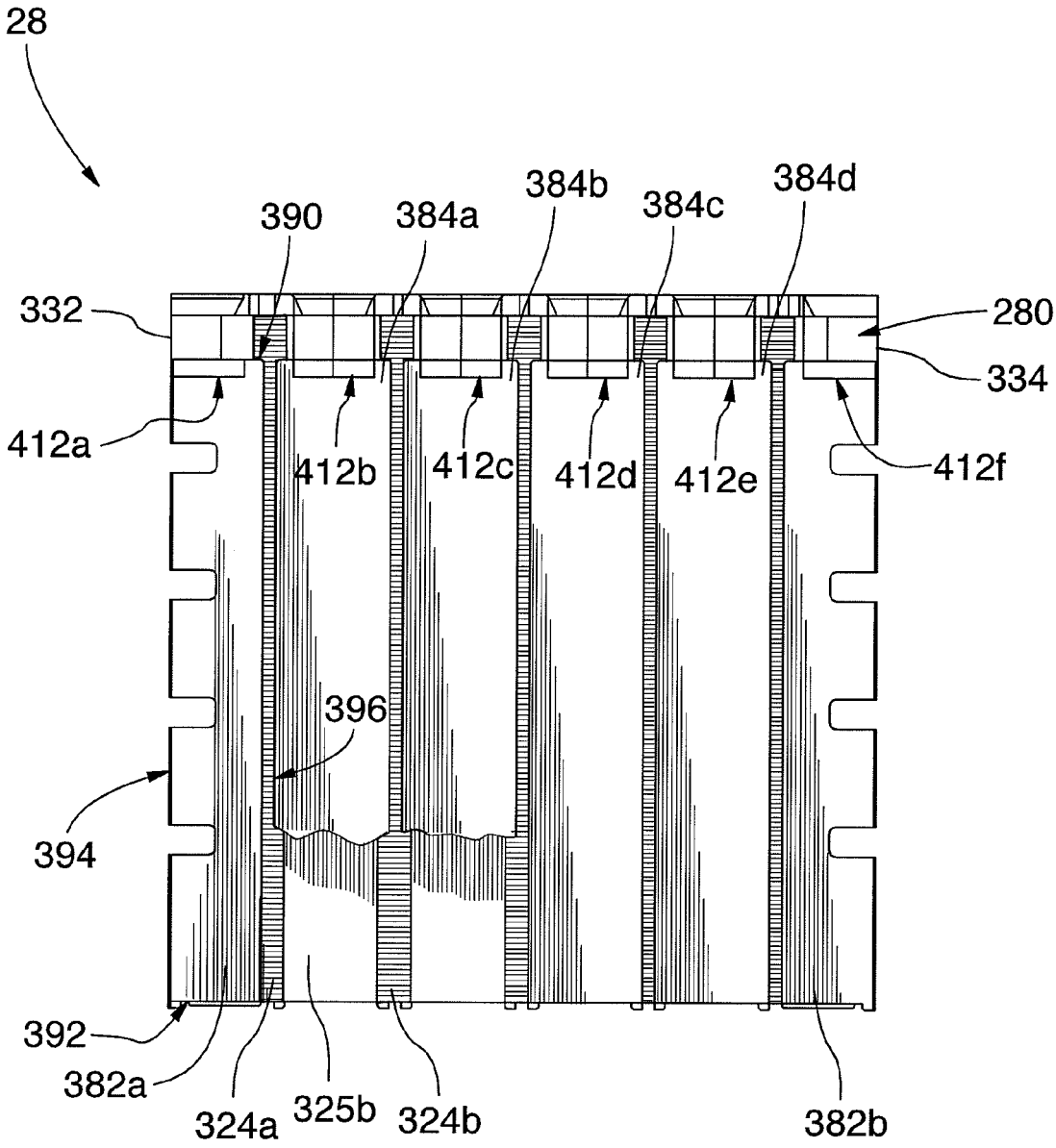
FIG. 17 is a front elevation view of the ram shown in FIG. 12, with a pair of push plates partially cut out for showing the grooves.

The ram 28 further comprises a plate mounting block 310 fixedly mounted to the front plate 300. The plate mounting block 310 is generally a thick block of steel having a back face 312 welded or otherwise fastened to the front plate 300, a front face 314, top and bottom faces 316,318 and side faces 320,322. In one embodiment of the present invention, the front face 314 comprises a plurality of vertical grooves 324*a*-324*e* extending from the top face 316 to the bottom face 318. The grooves 324*a*-324*e* are sized and shaped for receiving therein the corresponding plurality of vertical needles 101*a*-101*e* of the wire-catch assembly 38 during the operation of the baler 20. Therefore, the front face 314 of the mounting block 310 defines somewhat of a crenellated surface comprising the grooves 324*a*-324*e* and a plurality of merlons 325*a*-325*f*. As best shown in FIGS. 15 and 17, the bottom, top, left and right faces 318,316,320 and 322 of the mounting block 310 are aligned with the corresponding bottom, top and sides edges 304,302,305 and 308 of the front plate member 300 and are therefore adjacent to walls 44,70,50 and 52 of the housing 22 when the ram 248 is mounted therein.

In this embodiment, the ram 28 further comprise the blade mounting plate 280 (FIGS. 13 to 15) fixedly mounted in the seat 286 for mounting a plurality of blades 326*a*,326*b* and 327*a*-327*d* thereto, as it will become apparent below. The blade mounting plate 280 is a generally horizontal thick plate of steel having a back end 328 adjacent to the back face 284 of the seat 286, an opposed front end 330 and two side faces 332,334 extending therebetween. The mounting plate 280 also comprises a top face 331 and a bottom face 333. The mounting plate 280 defines a second, blade seat 336 for receiving blades 326*a*,326*b* and 327*a*,327*d* therein. As best shown in FIG. 17, the sides faces 332,334 of the blade mounting plate 280 are vertically aligned with the exterior face of the side frame members 268,269, and are therefore adjacent to the side wall 50,52 of the housing 22 when the ram 248 is assembled therein.

Similarly to the first seat 286 (i.e. the seat for receiving the mounting plate 280), the blade seat 336 comprises a bottom face 338 extending horizontally from the front end 330 of the plate 280 to an intermediate region located between the front and back ends 330,328, and a back face 340 extending generally vertically between the top face 331 of the plate to the bottom face 338 of the second seat 336. This configuration of the second seat 336 enables both horizontal and vertical access for placing the blades 326*a*-327*d* in the seat 336.

Figure 18:
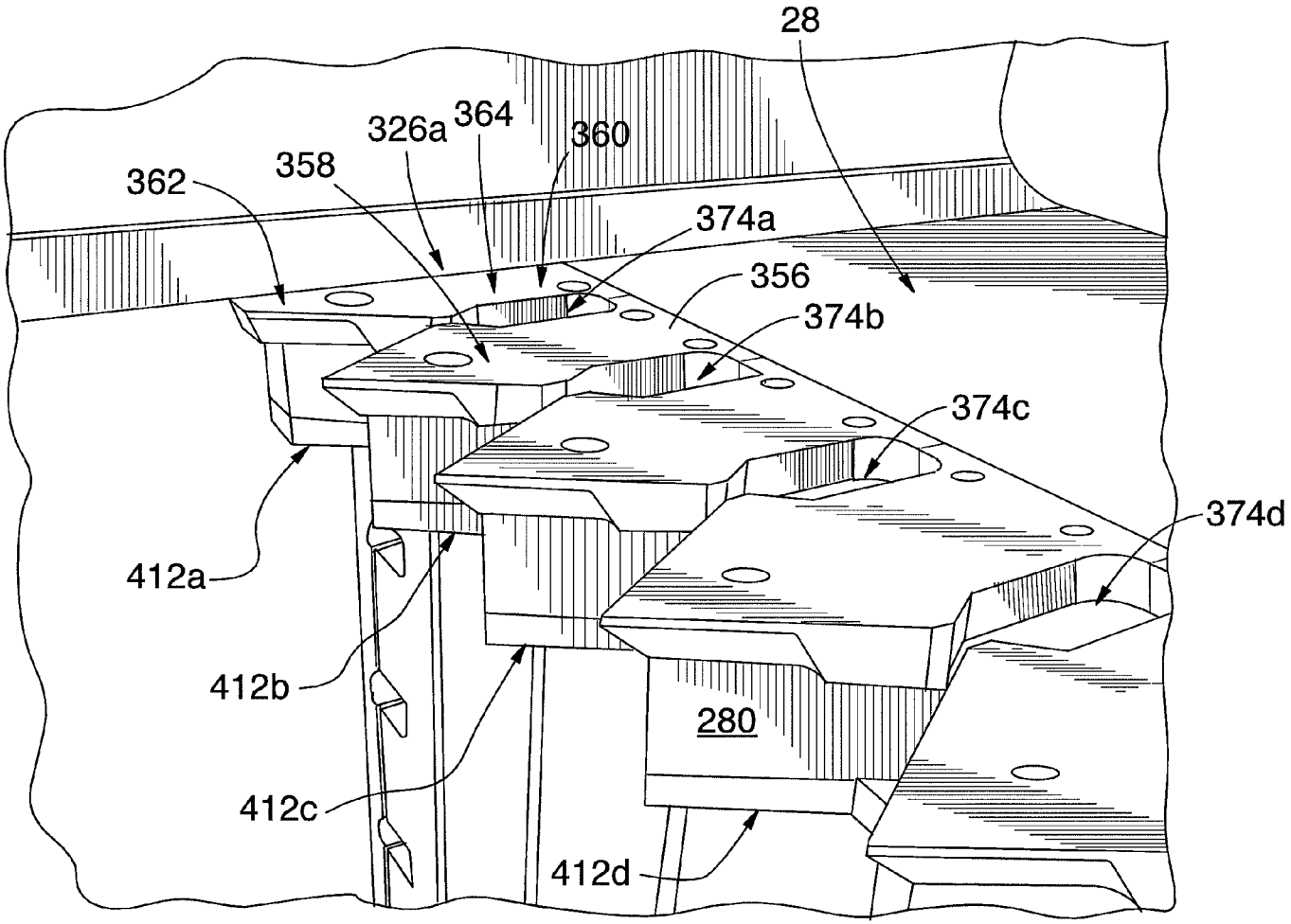
FIG. 18 is an enlarged, partial front right perspective view of the ram shown in FIG. 12 mounted in the compaction chamber of the housing.

On the front end 330 thereof, the blade mounting plate 280 is provided with a plurality of generally diamond shape teeth 340*a*-340*d* and two, generally half-diamond shaped lateral teeth 341*a*,341*b*, horizontally distributed along the front end 330 and defining together somewhat of a zigzag configuration between the side faces 332,334 (shown in FIGS. 14 and 18). Each tooth 340*a*-341*b* include a wide base (not shown) and two angular faces 344,346 extending respectively from the base toward each other to define a tapering structure terminating in a tip 348. The teeth 340*a*-341*b* are directed toward the front end 42 of the housing 22 and protrude in front of the plate mounting block 310 when the ram 248 is in operation, and are connected thereto via connecting portions 343*a*-343*f*. In one embodiment, the blade mounting plate comprises between 1 and 20 teeth, and preferably between 3 and 10 teeth, and more preferably 6 teeth.

Between each pair of adjacent teeth (e.g. between teeth 340*b* and 340*c*), the blade mounting plate 280 is provided wire-catch, vertical receiving slots 350*a*-350*e*. Each slot 350*a*-350*e* extends vertically between the top and bottom faces 331,332, from the front end 330 of the blade mounting plate 280, backward from the base 342 of the teeth 340*a*-341*b*, or, in other words, between the adjacent connecting portions 343*a*-343*f* of the plate 280. The wire catch slots 350*a*-350*e* are shaped and sized for receiving therein the plurality of needles 101*a*-101*e* of the wire catch assembly 38 during operation of the baler 20. As such, each slot 350*a*-350*e* has a width and depth similar to those of the vertical grooves 324*a*-324*e* of the mounting block 310, and are vertically aligned therewith when the blade mounting plate 280 is properly positioned in its seat 286.

Figure 19:
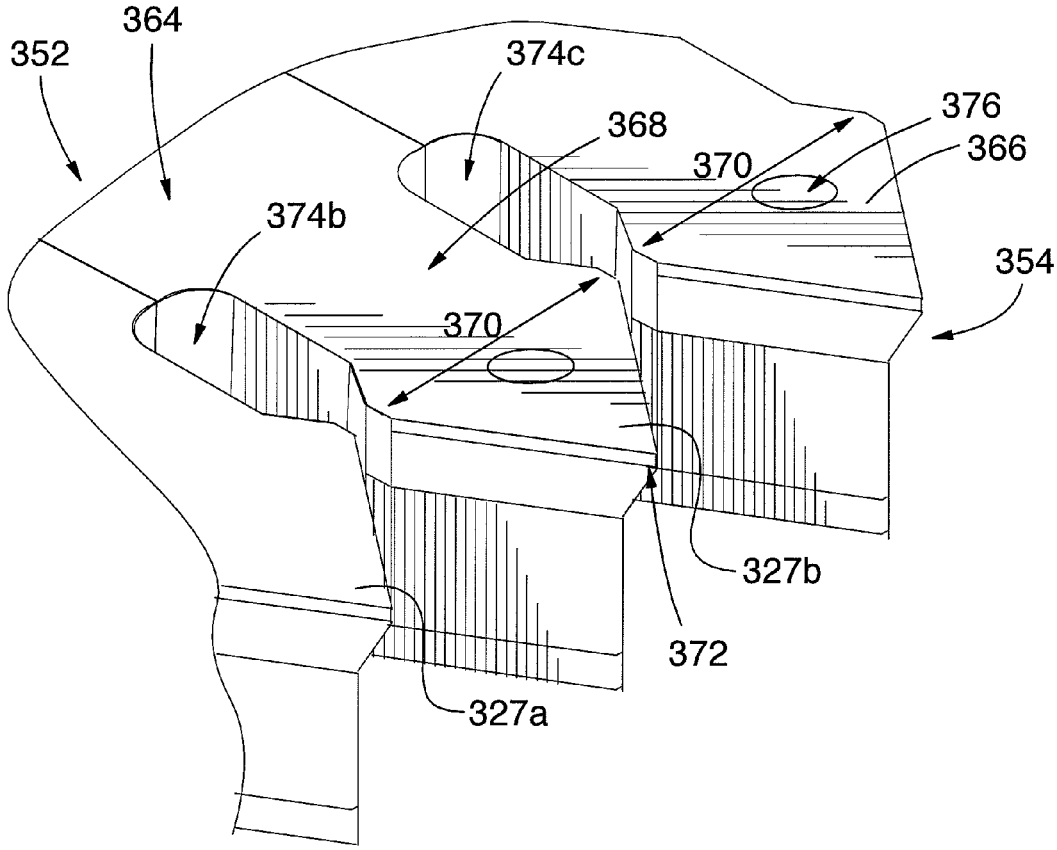
FIG. 19 is a partial front left perspective view of a mounting plate and blades in accordance with one embodiment of the present invention.

The mounting plate 280 is preferably provided with a plurality of threaded bores (not shown) defined in the blade seat 286 for receiving therein a corresponding plurality of bolts (not shown) for mounting the blades 326*a*-327*d* to the seat 286. Each tooth 326*a*-327*d* has a back end 352 and a front end 354, and top and bottom faces 356,358, respectively (shown in FIG. 15). As best shown in FIGS. 18 and 19, each tooth 326*a* and 326*b* comprises a base portion 360 (at the back end 352), a generally half diamond-shaped tip portion 362 (at the font end 354), and a connecting portion 364 for connecting the tip portion 358 to the base 356. Similarly to teeth 326*a*-326*b*, each tooth 327*a*-327*b* is provided with a base portion 364, a diamond-shaped tip portion 366 and a connecting portion 368 for connecting the tip portion 366 to the base 364. The base portions 360,364 of each tooth 326*a*-327*d* are configured to lie against the back face 340 of the seat 336 and to adjoin the base portions 360,364 of an adjacent tooth 326*a*, 327*d* such that the base portions 360,364 of the teeth 326*a*, 327*d* together extend between the side faces 332,334 of the blade mounting plate 280. Together, the tip portions 362,366 of the teeth 326*a*-327*d* define somewhat of a zigzag configuration at the front end 254 of the ram 248.

Each tip portion 362,366 comprises a wide crown portion 370 and a tip 372. In one embodiment, the tip portions 372 of teeth 326*a*-327*d* taper from the top face 356 toward the bottom face 358, in addition of tapering from the crown 370 to the tip 372. In one embodiment, each tooth 326*a*-327*d* is sized and shaped to match the configuration of a corresponding tooth 340*a*-340*f* of the mounting plate 280. This configuration tends to increase the efficiency of the teeth 358*a*-360*b* when the ram 248 is in operation, as it will become apparent below.

Defined between the connecting portions 364,368 of the teeth 326*a*-327*d* is a plurality of wire-catch receiving slots 374*a*-374*e* extending between the base portions 360,364 and the tip portions 362,366. Still referring to FIG. 19, the crown portions 370 of the teeth 326*a*-327*d* extend toward each other, therefore narrowing the width of the slots 374*a*-374*e* at this location. In one embodiment, this distance is adapted for allowing vertical wires to exit the slots 381*a*-381*e* when the ram 248 moves from the extended position to the retracted position, while minimizing the amount of material the may lodge in the slots 381*a*-381*e* upon compaction.

In one embodiment, the each tooth 326*a*-327*d* comprises a plurality of flanged holes 376 for removably mounting the tooth 326*a*-327*d* to the seat 336 with fasteners such as bolts (not shown). This configuration facilitates removal of each individual blade 326 from the seat 336 for maintenance purposes, for instance. A person skilled in the art will appreciate that the teeth 326*a*-327*a* could be fixedly mounted to the platen 256, for instance by welding, or form an integral structure mounting block 310 such as, for instance, by simultaneously casting the platen and the blade to obtain a monolithic platen 256. In such an embodiment, post casting operations could be required to sharpen the blade 326, for instance.

Mounted on each merlon 325*a*-325*f* (i.e. the frontmost portions of the front face 314 of the mounting block 310) and extending generally vertical is a plurality of generally vertical push plates 382*a*-384*d*. In one embodiment, the ram 248 comprises two mirror image lateral push plates 382*a*, 382*b*, mounted on each side of the mounting block 310 and four regular push plates 384*a*-384*d*, mounted to the block 310, between the lateral push plates 382*a*-382*b*. The push plates 384*a*-384*d*, are preferably made from steel, while any suitable material capable of sustaining the pressure forces of compaction process could be used.

The lateral push plates 382*a*-382*b*, being mirror images of one another, only lateral push plate 382*a* will be described for the purpose of the current specification. A person ordinary skilled in the art will appreciate that a similar description will apply, with proper adaptation, to lateral push plate 382*b*. The lateral push plate 382*a* comprises a front face 386, an opposed back face 388, adjacent to the front face 314 of the mounting block 310, a top edge 390, a bottom edge 392, a first side edge 394 (i.e. on the left side on FIG. 17) and a second side edge 396 (i.e. on the right side on FIG. 17) extending between the top and bottom edges 390,392. In this embodiment, the top edge 390 thereof partially adjoins the bottom face 333 of the mounting plate member 280, while the bottom edge 392 is proximal to the bottom wall 44 of the housing 22 during operation of the ram 248. The first side edge 394 is vertically aligned with the side member 268 of the frame 250 and is therefore adjacent to the side wall 50 of the housing 22 when the ram 248 is in position. The first side edge 394 is provided with a plurality of notches or recesses 398*a*-398*d*, and preferably with four recesses for receiving parts of a hold-on assembly, as known in the art. The second side edge 396 is generally linear and extends parallel to the first edge 394. Because the width of the lateral push plate 382*a* exceeds the width of the merlon 325*a*-325*f*, the lateral push plate 382*a* partially covers the groove 324*a* of the mounting block 310, as best shown in FIG. 17. This configuration is aimed at reducing the amount of recycled material entering the groove 324*a* during the operation of the ram 248, as best described below.

Similarly to lateral push plate 382*a*,382*b*, each regular push plate 384*a*-384*d* is provided with a back face 400 adjoining the front face 314 of the mounting block 310, a front face 402, a top edge 404 and a bottom edge 406. Extending between the top and bottom edges 404,406 are first and second, generally linear, side edges 408,410, (respectively on left and right, on FIG. 17). In this embodiment, the top edge 404 thereof adjoins a portion of the bottom face 333 of the plate mounting member 280, while the bottom edge 406 is proximal to the bottom wall 44 of the housing 22 during operation of the ram 248. Because the width of the push plate 384 exceeds the width of the merlons 325*a*-325*f* (e.g. merlon 325*b*), the push plate (e.g. 384*a*) partially covers the grooves located on each side of the merlons (e.g. grooves 324*a* and 324*b* on each side of merlon 325*b*, as best shown in FIG. 17. In one embodiment, the distance between adjacent push plates generally correspond to the distance between the crown portion 370 of adjacent teeth 326*a*-327*d* and is adapted for allowing the passage of a vertical wire when the ram 248 moves from the extended position toward the retracted position, while limiting the amount of recycled material entering the grooves 324*a*-324*e* of the mounting block 310 when such recycled material is compacted.

Mounted under the bottom face 333 of each tooth 340*a*-341*b* of the base mounting plate 280 and extending from the front face 402 of the push plates 382*a*-384*d* to the tip 348 of the teeth 340*a*-341*b* is a plurality of generally triangular push plate protecting members 412*a*-412*f*. Each protecting member 412*a*-412*f* is aimed at stabilizing a corresponding push plate 382*a*-384*d* and comprises a top face 414 adjacent to the bottom face 333 of a corresponding tooth 382*a*-384*b*, a bottom face 416, a back edge 418 adjoining the push plate member 382*a*-384*b* and two tapering side edges 420,422. Each protecting member 412*a*-412*f* has a perimeter adapted to fit the perimeter of a corresponding tooth 340*a*-341*b* and is mounted thereto using a bolt (not shown) engaging a corresponding threaded hole (not shown) in the tooth.

A person skilled in the art will appreciate that numerous ram configuration are possible. For instance, where a horizontal wire-catch assembly is used, the cutting portion of the ram may not require the presence of separate teeth and wire-catch slots. Moreover, the ram may be configured for used with both horizontal and vertical wire-catch assemblies for cross-tying the bales produced.

Now returning to FIGS. 1 to 3, the configuration of the extrusion channel 36 will be described in accordance with one embodiment of the present invention. According to one embodiment of the present invention, the extrusion channel 36 comprises a fixed bottom wall 434, a movable top wall 432 and a pair of movable side walls 428,430. In this embodiment, the bottom wall 434 comprises a back end 424 fixedly connected to the front end 42 of the housing 22, and a front end 426. Between the back end 424 and the front end 426, the bottom wall 434 is provided with a top, inner face 436, an opposed bottom face 438 and a pair of side faces joining the top and bottom faces 440,442. The bottom wall 434 is fixedly mounted to the front end 42 of the housing 22, in horizontal alignment therewith. More specifically, the top face 436 of the bottom wall 434 is horizontally aligned with the inner face of the bottom wall 44 of the housing 42 to avoid any level difference at the junction of the walls 44,434 in which recycled material could remain jammed while traveling from the compaction chamber 26 to the extrusion channel 36.

Figure 2:
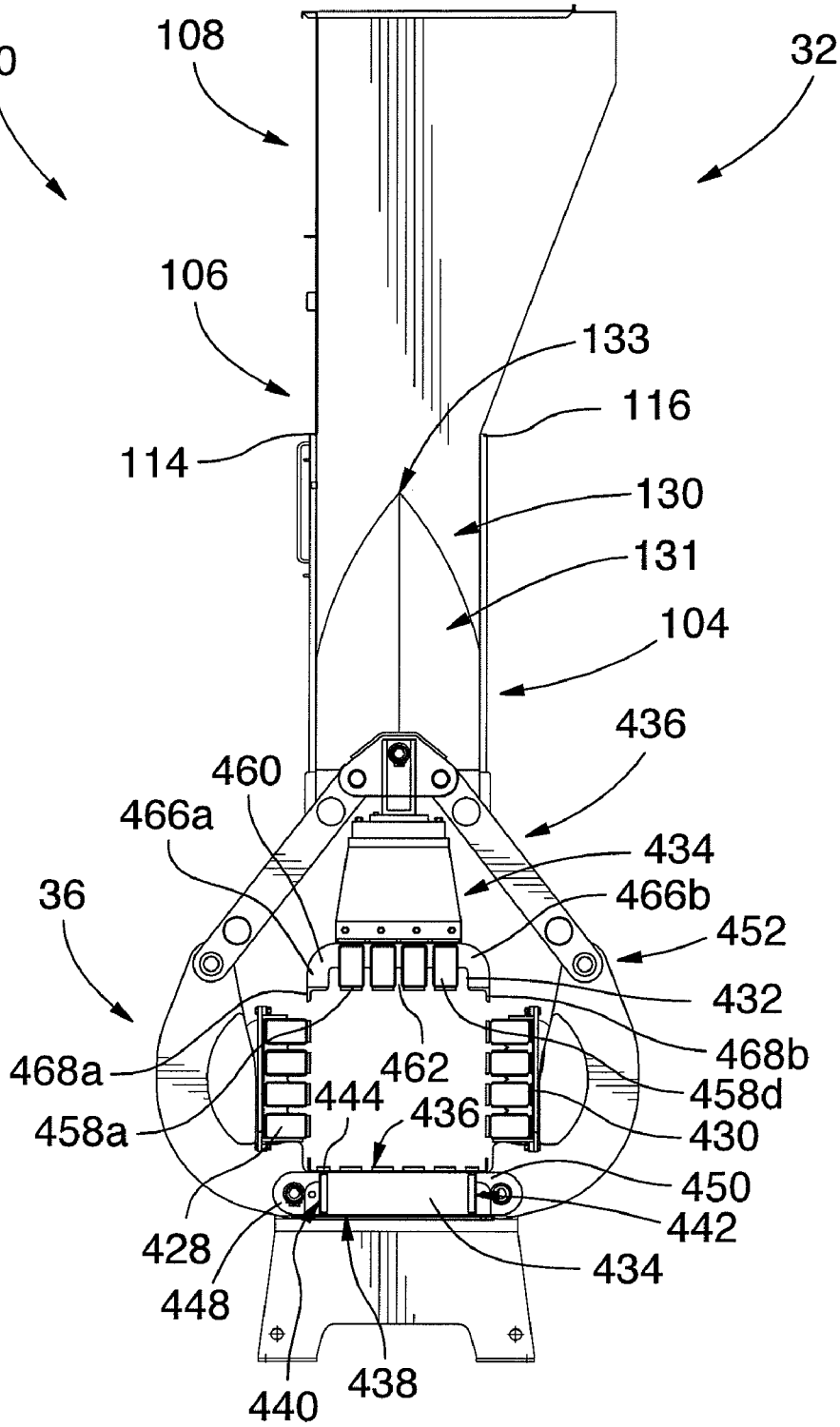
FIG. 2 is a front elevation view of the single ram baler shown in FIG. 1.

In one embodiment, the bottom wall 434 is provided with a plurality of elongated, generally parallel strips 444 of metal fixedly mounted to the top face 434 and extending between the back and front ends 424,426. As best shown in FIG. 2, these strips 444 are mounted to the top face 436 so as to define spaces 446 therebetween. The spaces 446 are configured for receiving therein wires of a wiring assembly (not shown). Mounted to the side faces 440,442 of the bottom wall 434, between the back end 424 and the front end 426 is a pair of pivot brackets 448,450 for pivotably mounting a clamp assembly 452 to the bottom wall 434, as best described below.

Similarly to the bottom wall 434, the top wall comprises a back end 454, movably connected to the front edge 74 of the top wall 70 and a front end 456. The top wall 434 is provided with four (4) elongated, rectangular cross-sectioned beams 458*a*-458*d* extending between the back end 454 and the front end 456 and connected to one another by a plurality of inverted U-shaped cross-members 460. In one embodiment, the beams 458*a*-458*d* are parallel and spaced from one another so as to define spaces 464 therebetween for receiving wires of the wiring assembly (not shown). As best shown in FIG. 3, the cross members 458*a*-458*d* each comprises a generally horizontal portion 464 in connection with the beams 468*a*,468*d* and a pair of downwardly extending portions 466*a*,466*b* on each side of the beam 458*a*,458*d*. The top wall 434 is further provided with a pair of L-shaped beams 468*a*, 468*b*, each L-shaped beam 468*a*,468*b* being mounted to one of downwardly extending portion 466*a*,466*b* of the cross-members 460, and extending parallel to the main beams 458*a*, 458*b* between the back and front ends 454,456 of the top wall 434.

Each beam 458*a*-458*d* comprises an inner face 470, a outer face 472 and a pair of side faces 474,476. As best shown in FIG. 2, the distance between the outer and inner faces 472, 470 of the beams 458*a*-458*d* slightly increases from the back end 454 toward the front end 456, until an intermediate location 478 between the back and front ends 454,456. Further, the L-shaped beams 468*a*-468*b* are bent so as to follow the profile of the beams 468*a*-458*d* between the back and front ends 454,456. In other words, the L-shaped beams 468*a* and 468*b* are configured to extend slightly downwardly from the back end 454 toward the intermediate location 478. The configuration of the beams 458*a*-458*d*, and of the L-shaped beams 468*a*-468*b* provides the extrusion channel 36 with a cross-section from the back end 454 to the intermediate location 478, as it will become apparent below.

At the back end 454 thereof, the top wall 434 is provided with a generally elongated hole 486 (e.g. an oblong or rectangular hole) extending horizontally between the side faces 474,476 of the beams 458*a*-458*d*. The elongated hole 486 is adapted for receiving therein a mounting rod 488 and rollers (not shown) for mounting the top wall 434 of the extrusion channel 36 to the top bracket 109 of the housing 42 (shown in FIG. 4). In this embodiment, the elongated hole 486 is sized and shaped for allowing a limited vertical movement (i.e. upwardly and downwardly) of the back end 454 of the top wall 434.

The side walls 428,430 being mirror images of one another, only side wall 428 will be described. A person skilled in the art will appreciate that a similar description also applies to side wall 430. The side wall 428 has a back end 490, a front end 492 and comprises four (4) rectangular cross-sectioned beams 494*a*-494*d* extending between the back and front ends 490,492. The beams 494*a*,494*d* are distributed vertically and connected to one another by a plurality of cross-members 496. Similarly to beams 458*a*,458*d* of the top wall 434, the beams 494*a*-494*d* of the side wall 428 are spaced-apart from one another so as to define spaces 498 therebetween. The spaces 498 are adapted for receiving therein wires of the wiring assembly when using a horizontal tying or cross-tie assembly (not shown).

At the back end 490 thereof, the side wall 428 is provided with a generally elongated hole (not shown) extending vertically through the beams 494*a*-494*d*. The elongated hole is adapted for receiving therein a mounting rod (not shown) and rollers (not shown) for mounting the side wall 428 of the extrusion channel 36 to the side bracket 103 of the housing 42. In this embodiment, the elongated hole is sized and shaped for allowing a limited horizontal movement (i.e. from left to right on FIG. 20) of the back end 490 of the side wall 428.

Figure 20:
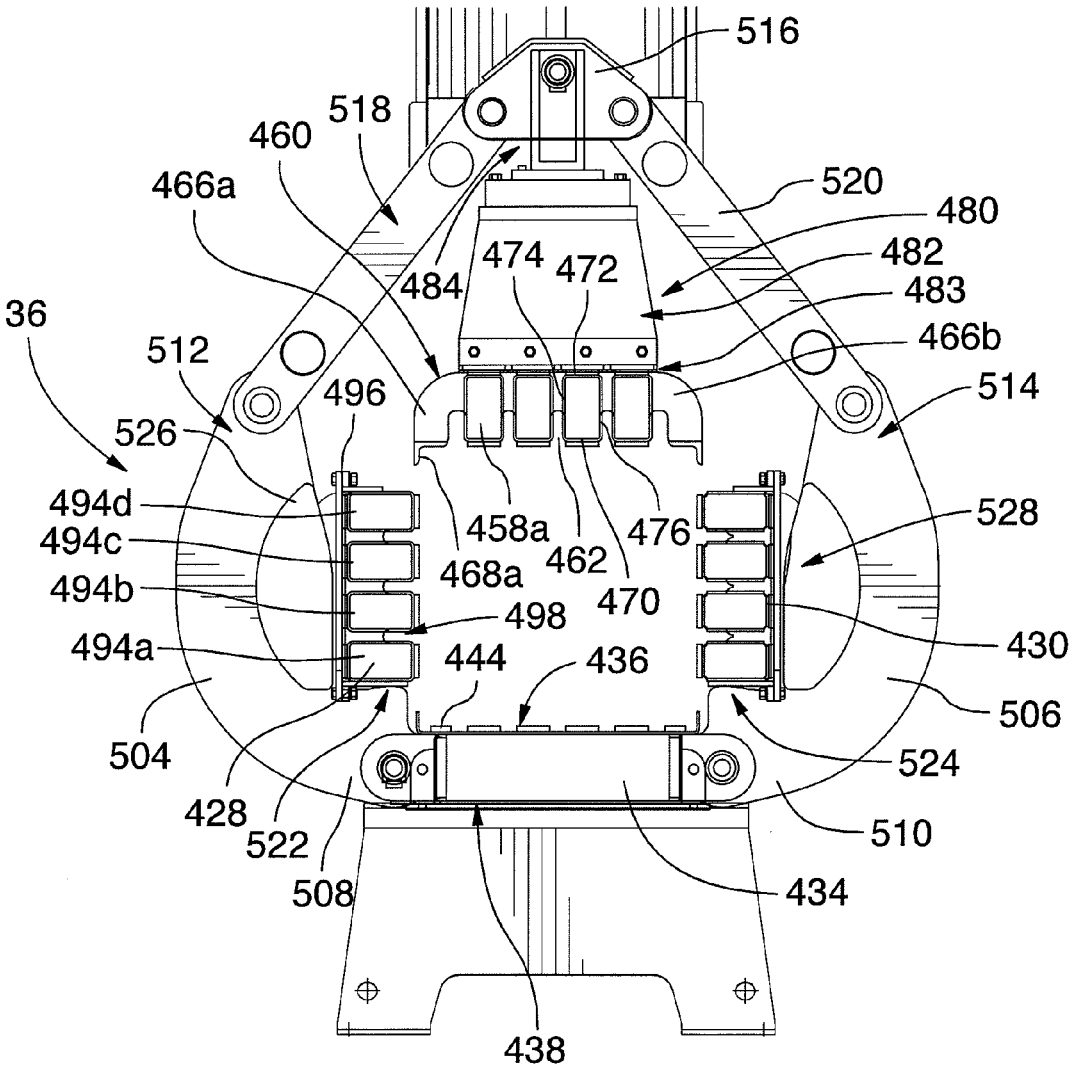
FIG. 20 is an enlarged front elevation view of the single ram baler in accordance with one embodiment of the present invention.

Still referring to FIG. 20, the extrusion channel 36 is provided with a clamp assembly 480. The clamp assembly 480 comprises a vertically extending hydraulic cylinder 482 having a bottom end 483 resting on the top wall 432 and a top end 484. The claim assembly 480 further comprises a pair of side wall supporting members 504,506 each having a bottom end 508,510 pivotably connected to the pivot brackets 440,442 of the bottom wall 434 and a top end 512,514, an actuator bracket 516 mounted to the top end 484 of the hydraulic cylinder 482. The clamp assembly 480 further comprises a pair of connecting members 518,520, each connecting member 518,520 pivotably connecting the top end 512,514 of one supporting member 504,506 to the actuator bracket 516. The supporting members 504,506 each comprise a wall supporting portion 522,524 on which a corresponding side wall 428, 430 is vertically supported and a push portion 526,528 lying against the side wall.

As it will be apparent for a person skilled in the art, when the hydraulic cylinder 482 is actuated (i.e. when it moves from a retracted position to an extended position), it forces the top wall 432 to move toward the bottom wall 434 and causes the sides walls 428,430 to move toward one another. Therefore, the actuation of the hydraulic cylinder 482 enables modulation of the cross-section of the extrusion channel 36. Further, due to the presence of the elongated holes 486 and the position of the clamp assembly 480 between the back and front ends 424,426, the cross-section of the extrusion channel 36 can be modified along its entire length. This configuration of the clamp assembly provides with enhanced control over the bale retention as multiple bales are formed and move towards the front end of the extrusion channel 36.

Having generally described the baler 20, a first mode of operation of the baler 20 will be described in accordance with one embodiment of the present invention, referring to FIGS. 21A to 21D. In this embodiment, the baler 20 is used to bale large pieces of compactable material, such as, for instance, large pieces or sheets of corrugated cardboard. This first mode of operation is particularly desirable when the material to be baled is fed in the compaction chamber 26 but some individual pieces of such material are too large for being completely received within the compaction chamber 26 and a portion thereof extends in the feeding assembly 32, and more particularly higher than the tip 133 of the extension 131 of the front wall 130. As such, in one embodiment, the tip 133 of the extension 131 of the front wall 130 determines the maximum loading height for loading material where preflap assembly 34 is to be used. Taking the corrugated cardboard as an example, it is known in the art that the presence of such material in the feeding assembly (e.g. feeding assembly 32) is susceptible to interfere with the proper operation of the preflap assemblies of the prior art. Indeed, the portion of the cardboard present in the feeding assembly may tend to become sandwiched between the preflap and the front wall 130 of such feeding assembly when the preflap moves from the open to the close position, therefore jamming operation of the preflap. In these occasions, prior art balers have to be shut down, and the material stuffed in the feeding assemblies thereof need to be manually removed to unblock the preflap. This tends to make the baler with preflaps of the prior art less efficient for compacting or baling large pieces of material such as corrugated cardboard.

Therefore, in this first mode of operation, the baler 20 is operated without using the preflap 142. In a first step, the hydraulic actuator 30 and the ram assembly 28 are in retracted position (shown in FIG. 21A). In this retracted position, the front end 254 of the ram 248 is located at the first intermediate region 84, therefore leaving the opening 86 fully open. The large pieces of cardboard 450 are fed in the upper portion 108 of the feeding assembly 32 using a conveyor, such as, for instance, a belt conveyor. The pieces of cardboard 450 fall by gravity and pass through the intermediate portion 106, the preflap receiving portion 104 and the opening 86 to be partially received in the compaction chamber 26. A first portion 454 of the cardboard is accommodated in the compaction chamber 26 while a second portion 452 of remains in the feeding assembly 32 the preflap receiving portion 104, the cardboards 450 being sized too large for being fully received in the compaction chamber 26.

Figure 22A:
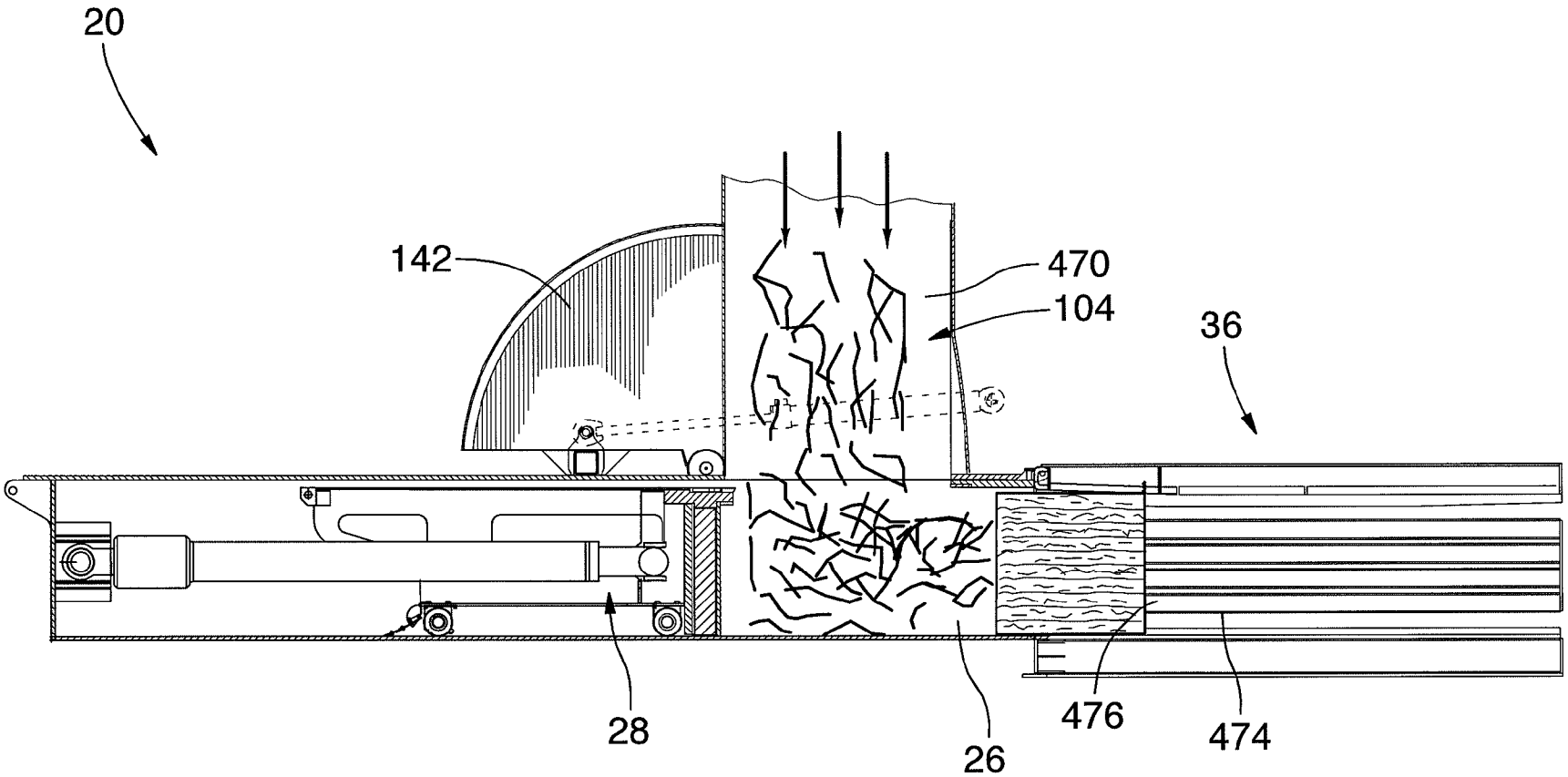
FIGS. 22A to 22E illustrate a single ram baler in operation according to another embodiment of the present invention.
Figure 22B:
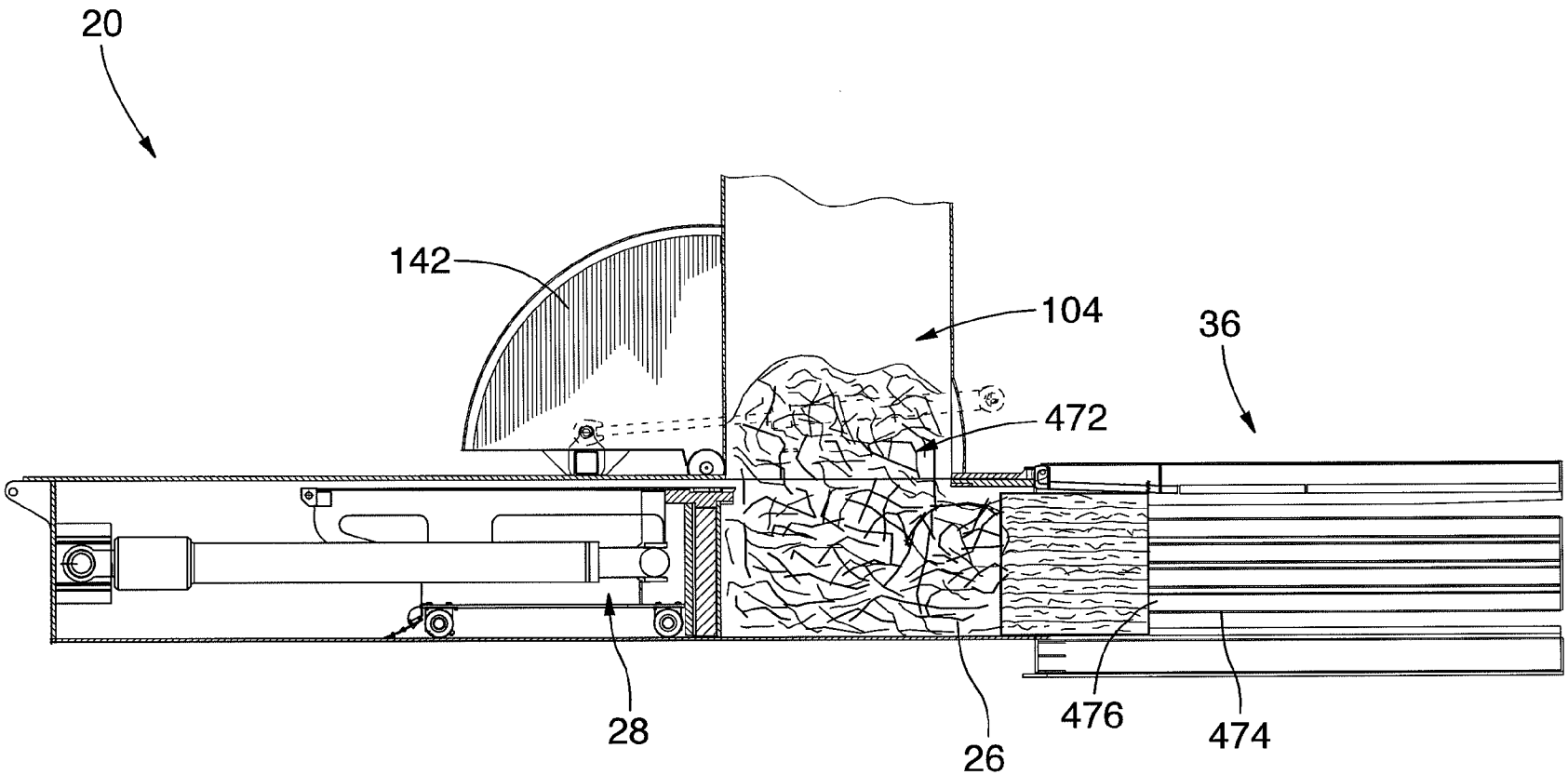

As the ram assembly 28 moves from the retracted position towards the extended position, the front end 254 of the ram 248 pushes the pieces of cardboard 450 frontwardly or, in other words, towards the front end 42 of the housing and the front wall 130 of the preflap receiving portion 104 (best shown in FIG. 22B). This causes the cardboards 450 to lie against the V-shape edge 94 of the opening 86 and the front wall 130 of the preflap receiving portion 104, therefore pressing the pieces 450 against one another.

As the ram assembly 28 still moves towards the extended position, the front end 254 of the ram 248 reaches the second intermediate region 96. At this position, the blade 326 meet the V-shape edge 94 of the opening, therefore severing the pieces of cardboard 450 extending in the preflap receiving portion 104 as it continues to move toward the extended position. The severed portion 452 of the cardboard still present in the preflap receiving portion 104 fall on the top face 288 of the ram 248, which prevents those from falling behind the ram 248 as is pursue its course towards the extended position (best shown in FIG. 22C).

The portion 454 of the cardboard 450 present in the compaction chamber 26 is moved forward, towards the front end 42 of the compaction chamber 26. The front end 254 of the ram 248 forces the material against a first bale of material 456 present in the extrusion channel 36. The extrusion channel 36 frictionally maintaining the first bale 456 in place in the extrusion channel 36, it provides somewhat of a front surface 458 against which the cardboard pieces 454 can be pushed and compacted into a second bale 460.

When the ram assembly 28 reaches the extended position, the slots 350*a*-350*e* and 381*a*-381*e* of the blade mounting plate 280 and the blade 326, respectively, and the grooves 324*a*-324*e* become vertically aligned with the corresponding wire catch slots 102*a*-102*e* defined on the top wall 70 of the housing 42, therefore enabling needles 101*a*-101*e* of the wire catch assembly 38 to operate for catching wires for wiring the newly formed second bale 460.

The ram 248 is then moved toward the retracted position, for baling other material fed in the feeding assembly 32. As the ram 248 moves towards such retracted position, the severed pieces of cardboard retained in the preflap receiving portion 104 by the top face 288 of the ram 248 lies against the back edge 92 of the opening 86 and the bottom face 172 of the preflap 142 in open position. This forces the severed pieces of cardboard to fall in the compaction chamber 26, in front of the ram 248, for further being compacted simultaneously to newly fed material (FIG. 22D).

As it will be appreciated by a person skilled in the art, numerous compaction cycles may be required for forming a bale. In other word, the ram 248 may have to perform multiple reciprocations between the retracted position and the extended position, where material is fed in the compaction chamber 26 at each reciprocation, to obtain bales of proper dimension and density.

Where the material to be baled is of smaller dimension, it may be desirable to pre-compact the material in the compaction chamber 26 therefore uniformizing the density of the bales produced and to increase the amount of recycled material compacted at each reciprocation of the ram 248. This second mode of operation of the baler 20 may be particularly useful when the material to be baled comprises aluminum can, plastic containers (e.g. plastic bottles, lids, and the like) or small pieces of cellulose material such as sheets of paper, newspapers, flyers and cardboard. Further, it tends to reduce energy consumption as the ram 28 is not required to shear or sever material.

Such an embodiment of the present invention will be described, referring to FIGS. 22A to 22E. In a first step, the hydraulic actuator 30 and the ram assembly 28 are in retracted position (shown in FIG. 22A). In this retracted position, the front end 254 of the ram 248 is located at the first intermediate region 84, therefore leaving the opening 86 fully open. The recycled material 470, in this example, sheets of papers, are fed in the upper portion 108 of the feeding assembly 32 using a conveyor, such as, for instance, a belt conveyor. The sheets of paper 470 fall by gravity and pass through the intermediate portion 106, the preflap receiving portion 104 and the opening 86 to be partially received in the compaction chamber 26. The amount of material fed in the feeding assembly 32 through the conveyor (not shown) is adapted for a portion 472 of the material to remain in the preflap receiving portion 104 when the preflap 142 is in open position (best shown in FIG. 22B). The amount of material 472 present in the preflap receiving portion 104 is adjusted to provide a bale having a generally uniform density and take into consideration the nature of the fed material (i.e. plastic, aluminum or paper) and the force to be exerted by the preflap 142 upon movement thereof from the open position to the close position.

When the compaction chamber 26 and the preflap receiving portion 104 of the feeding assembly 32 are satisfactorily loaded, the actuator assembly 144 of the preflap 142 is actuated, causing the actuators 230,232 to move from the extended position to the retracted position and the preflap 142 to move from the open to the close positions.

Figure 22C:
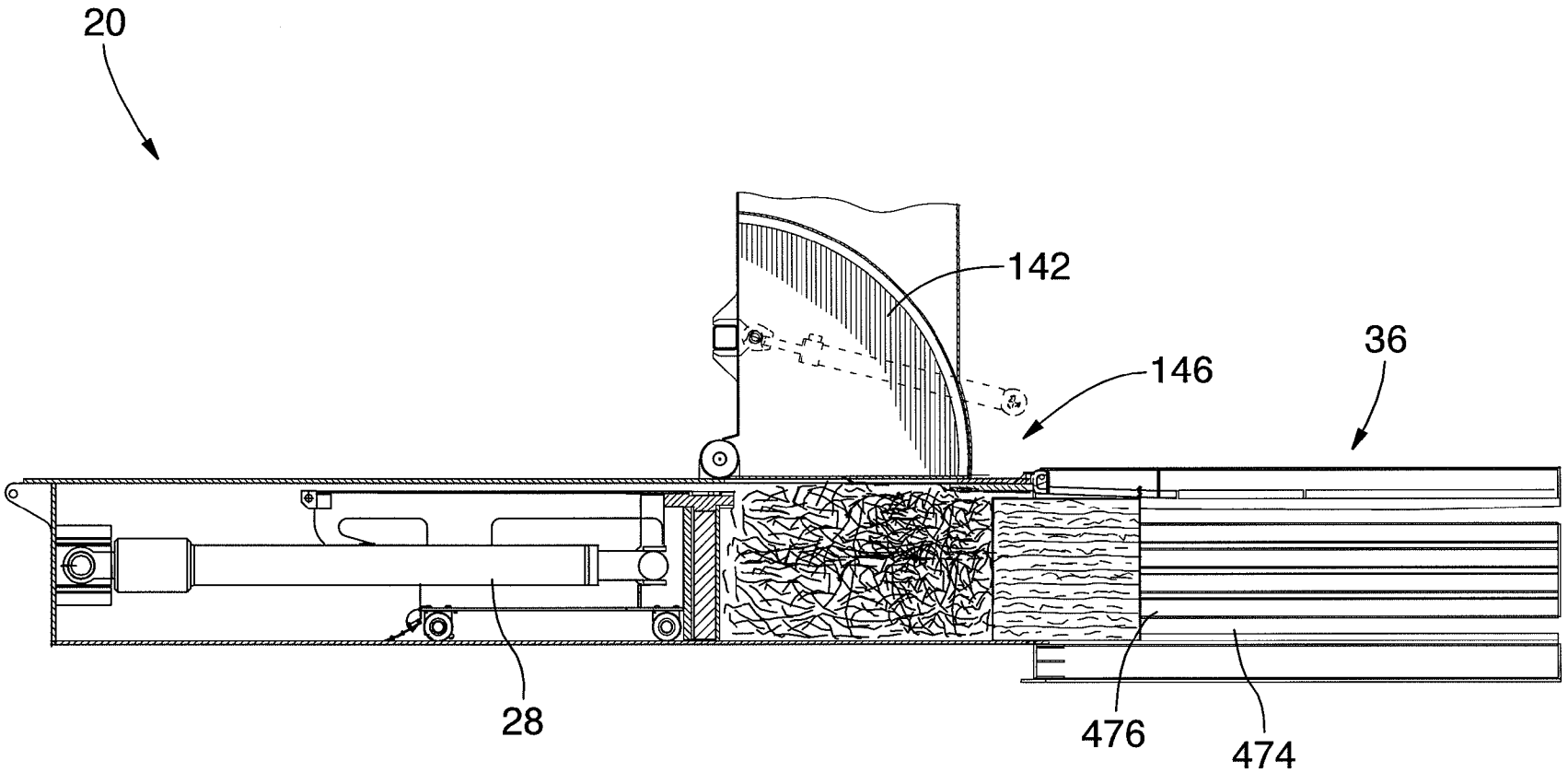
Figure 22D:
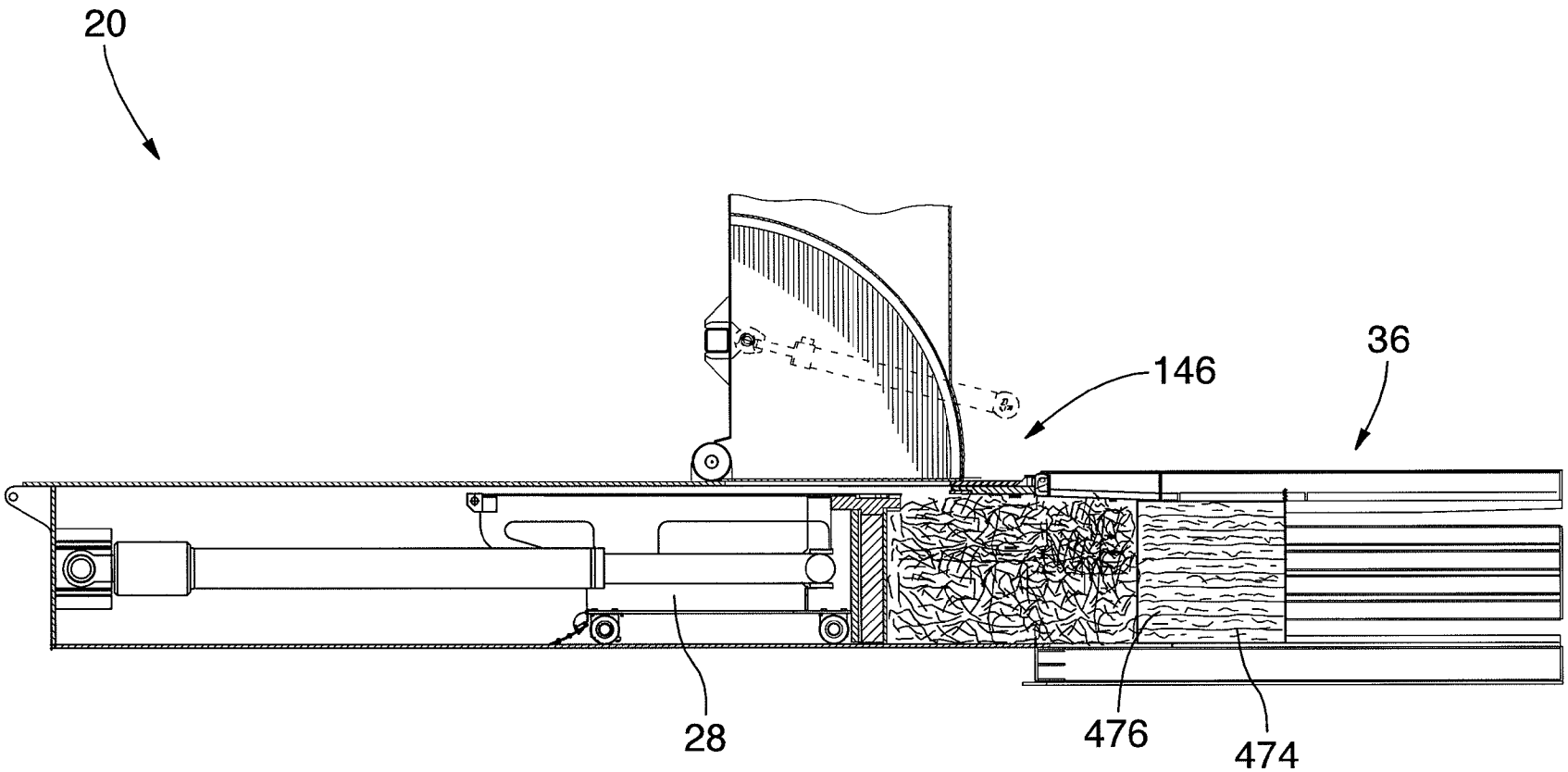

As the preflap 142 moves from the open position to the close position, the bottom face 172 thereof lies against the material 472 present in the preflap receiving portion 104, forcing the same to move in the compaction chamber 26 and be pre-compacted (best shown in FIG. 22C). Once the preflap 142 is in close position, the hydraulic actuator 30 and the ram assembly 28 are actuated to move from the retracted position, position towards the extended position. In doing so, the front end 254 of the ram 248 pushes the recycled material towards the front end 42 of the housing (best shown in FIG. 22D).

Figure 22E:
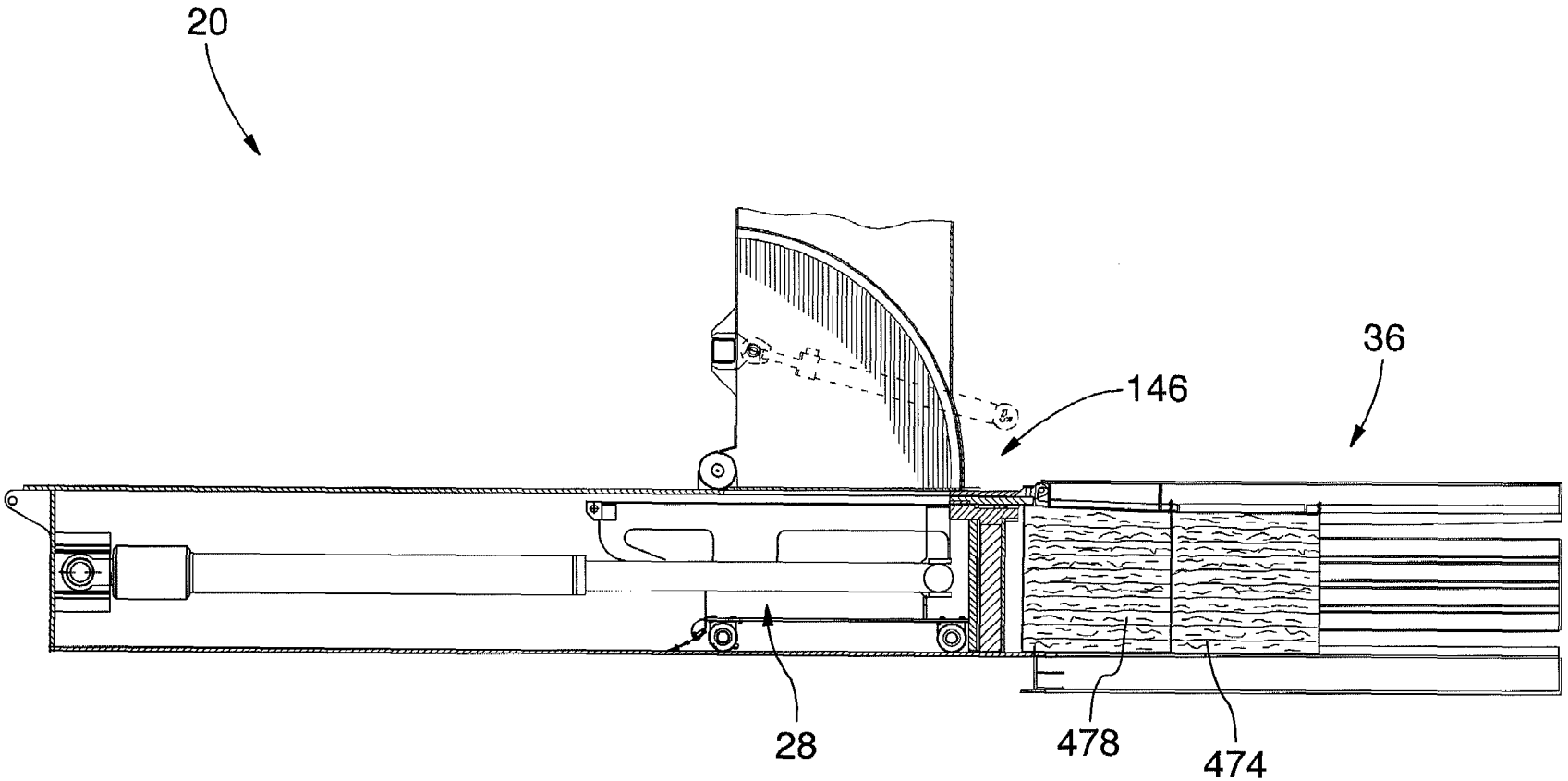

The configuration of the preflap 142 and of the feeding assembly 32 enables feeding further recycled material in the preflap receiving portion 104 and the intermediate portion 106 of the feeding assembly 32 while the ram 28 is in operation (not shown). More specifically, when the preflap 142 is in close position (as shown in FIGS. 22C to 22E), the opening 86 is closed by the bottom face 172 and the arcuate face 176 extends transversally in the preflap receiving portion 104. As further material is fed in the feeding assembly 32, it is received over the arcuate face 176 and contained partially in the preflap receiving portion 104 and the intermediate portion 106, over the preflap 142. When the preflap 142 is moved from the close position to the open position, the material contained over the preflap 142 slides on the arcuate face 176, retained by the back wall. This mode of operation further increases the efficiency of the baler 20 as less time is required for the feeding process.

Once the preflap 142 is closed, the front end 254 of the ram 28 forces the material against a first bale of material 474 present in the extrusion channel 36. Again, the extrusion channel 36 frictionally maintaining the first bale 474 in place in the extrusion channel 36, it provides somewhat of a front surface 476 against which the recycled material 470 can be pushed and compacted into a second bale 478 (FIG. 22E).

Similarly to the first mode of operation of the baler 20, when the ram assembly 28 reaches the extended position, the slots 381*a*-381*e* of the blade 326, the slots 350*a*-350*e* of the blade mounting plate 280 and the grooves 324*a*-324*e* become vertically aligned with the corresponding wire catch slots 102*a*-102*e* defined on the top wall 70 of the housing 42, therefore enabling needles 101*a*-101*e* of the wire catch assembly 38 to operate for catching wires for wiring the newly formed second bale 478.

The ram 28 is then moved toward the retracted position, for baling other material fed in the feeding assembly 32, for further compaction cycles. As it will be appreciated by a person skilled in the art, numerous compaction cycles may be required for forming a bale. In other word, the ram 28 may have to perform multiple reciprocations between the retracted position and the extended position, where material is fed in the compaction chamber 26 at each reciprocation, to obtain bales of proper dimension and density.

Although the foregoing description and accompanying drawings relate to specific preferred embodiments of the present invention as presently contemplated by the inventor, it will be understood that various changes, modifications and adaptations, may be made.

The invention claimed is:

1. A single ram baler for baling a material, said single ram baler comprising:

(a) a horizontal housing defining a compaction chamber therein and comprising a top wall;

(b) a feeding opening defined on said top wall of said housing for feeding said material in said compaction chamber, said opening having a given shape and being defined by a pair of side edges, a perpendicular back edge extending therebetween and a V-shaped front edge, spaced-apart from the back edge and extending between the side edges;

(c) a hopper mounted on said housing around said feeding opening for directing said material toward said opening, said hopper extending upwardly from said top wall and having a cross-section corresponding to said shape of said feeding opening, said hopper comprising a pair of generally vertical side walls, each side wall being adjacent to one of said side edges, a front wall extending between said side walls, adjacent to said front edge, at least a portion of said front wall being V-shaped; and a back wall extending between the side walls, said back wall comprising a preflap opening having a shape corresponding to the said shape of said feeding opening;

(d) a preflap pivotably mounted on said housing, the preflap being operable to pivot in said hopper between an open position for allowing said material to travel through said opening and a close position, the preflap comprising a bottom face comprising a pair of side edges, a perpendicular back edge extending therebetween and a V-shaped front edge, spaced-apart from the back edge and extending between the side edges for defining a shape corresponding to said shape of said feeding opening for substantially closing the same when said preflap is in said close position and to said preflap opening for substantially closing the same when said preflap is in said open position, said preflap further comprising an arcuate face, said arcuate comprising a pair of arcuate side edges and a centerline extending along a center portion of said arcuate face, the surface of said arcuate face being inclined from said centerline towards the respective arcuate side edges;

(e) a preflap actuating means operable for causing said preflap to pivot between said open and close positions, said bottom face of said preflap forcing said material present in said hopper to move in said compaction chamber when said preflap pivots from said open position to said close position;

(f) a press ram mounted for reciprocation in said compaction chamber between a retracted position for allowing feeding of said material in said compaction chamber and an extended position for compacting said material fed in said compaction chamber;

(g) a shear blades assembly comprising at least one moving blade mounted to said ram and at least one fixed blade mounted to said housing, said at least one fixed blade being vertically aligned with said front wall of said hopper; and (h) a press ram actuating means operable to cause reciprocation of said press ram in said compaction chamber between said retracted and extended positions, said at least one moving blade and said at least one fixed blade being configured for gradually severing material contained in said compaction chamber and extending through said opening as said press ram moves from said retracted position to said extended position.

2. The single ram baler of claim 1, wherein said material comprises a recycled material.

3. The single ram baler of claim 2, wherein said recycled material is selected from a group consisting of paper, cardboard, plastic, metal and fabric.

4. The single ram baler of claim 1, wherein said front edge defines said fixed blade.

5. The single ram baler of claim 1, wherein said press ram comprises a frame having a front end and a back end connected to said ram actuating means and a vertical platen mounted to said front end of said frame.

6. The single ram baler of claim 5, wherein said platen comprises a plurality of vertical grooves, said grooves being configured for receiving therethrough a corresponding plurality of needles of a vertical wire-catch assembly when said ram is in extended position and allowing the passage of wires when said ram moves from said extended position to said retracted position.

7. The single ram baler of claim 6, wherein said platen comprises a top portion, said at least one moving blade being mounted to said top portion of said platen, said at least one moving blade being configured for receiving therethrough said corresponding plurality of needles of said vertical wire-catch assembly when said ram is in extended position and allowing the passage of said wires when said ram moves from said extended position to said retracted position.

8. The single ram baler of claim 1, further comprising an extrusion channel operatively mounted to said housing, said extrusion channel being adapted for resisting the passage of said material when said press ram moves from said retracted position to said extended position, thereby allowing said material to be compacted into a bale.

9. The single ram baler of claim 8, wherein said extrusion channel comprises a bottom wall, a top wall and a pair of side walls, each of said walls having a back end in connection with said front end of said housing and a front end.

10. The single ram baler of claim 9, wherein at least one of said walls comprises a movable wall.

11. The single ram baler of claim 10, wherein said at least one movable wall is connected to said housing via a hinge assembly.

12. The single ram baler of claim 11, wherein said hinge assembly comprises a bracket assembly on said front end of said housing, an elongated hole extending through said at least one movable wall, at said back end thereof, and a rod fixedly mounted to said bracket assembly and extending through said elongated hole for allowing movement of said back end of said at least one movable wall relative to said housing.

13. The single ram baler of claim 11, the extrusion channel further comprising a clamp assembly for causing a portion of said at least one movable wall to move between an open position and a close position.

14. The single ram baler of claim 13, wherein said portion is at least one of said front end of said at least one wall and said back end of said at least one wall.

15. The single ram baler of claim 1, further comprising a wire-catch assembly operable for wiring said bale.

16. The single ram baler of claim 15, wherein said wire-catch assembly is selected from a group consisting of a horizontal wire catch assembly and a vertical wire catch assembly.

* * * * *